US007046198B2

(12) United States Patent
Sakiyama et al.

(10) Patent No.: US 7,046,198 B2
(45) Date of Patent: May 16, 2006

(54) ANTENNA AND APPARATUS PROVIDED WITH THE ANTENNA

(75) Inventors: Kazuyuki Sakiyama, Shijonawate (JP); Yasunao Okazaki, Kusatsu (JP); Michio Okajima, Neyagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 1 day.

(21) Appl. No.: 10/497,576

(22) PCT Filed: Dec. 2, 2002

(86) PCT No.: PCT/JP02/12612

§ 371 (c)(1),
(2), (4) Date: Jun. 3, 2004

(87) PCT Pub. No.: WO03/049227

PCT Pub. Date: Jun. 12, 2003

(65) Prior Publication Data

US 2005/0012675 A1 Jan. 20, 2005

(30) Foreign Application Priority Data

Dec. 4, 2001 (JP) ..... 2001-370041

(51) Int. Cl.
*H01Q 1/24* (2006.01)

(52) U.S. Cl. ..... 343/700 MS; 343/824; 343/876

(58) Field of Classification Search ..... 343/700 MS, 343/786, 815, 817, 824, 846, 853, 876; 333/258, 333/262

See application file for complete search history.

(56) References Cited

U.S. PATENT DOCUMENTS

| | | | | |
|---|---|---|---|---|
| 5,206,655 | A * | 4/1993 | Caille et al. | 343/700 MS |
| 5,444,454 | A | 8/1995 | White | |
| 5,576,718 | A * | 11/1996 | Buralli et al. | 343/700 MS |
| 5,619,365 | A | 4/1997 | Rhoads et al. | |
| 5,771,021 | A * | 6/1998 | Veghte et al. | 343/700 MS |
| 5,818,391 | A * | 10/1998 | Lee | 343/700 MS |
| 6,061,025 | A | 5/2000 | Jackson et al. | |
| 6,198,438 | B1 | 3/2001 | Herd et al. | |
| 6,384,785 | B1 | 5/2002 | Kamogawa et al. | |
| 6,417,807 | B1 * | 7/2002 | Hsu et al. | 343/700 MS |
| 6,700,542 | B1 * | 3/2004 | Borlez et al. | 343/700 MS |
| 6,885,345 | B1 * | 4/2005 | Jackson | 343/700 MS |

FOREIGN PATENT DOCUMENTS

| | | |
|---|---|---|
| EP | 0 474 490 A1 | 3/1992 |
| EP | 1 003 223 A2 | 5/2000 |

(Continued)

*Primary Examiner*—Tho Phan
(74) *Attorney, Agent, or Firm*—Akin Gump Strauss Hauer & Feld, LLP

(57) ABSTRACT

The present invention provides an antenna in which, on a dielectric substrate 1 having a back face on which a grounding conductor plate 14 is disposed, a plurality of conductor elements 12 are arranged in a matrix of rows and columns. Each of the dielectric elements 12 has a size which cannot function as an antenna. Above the conductor elements 12, a connecting element 13 overlapping two adjacent conductor elements 12 is disposed. Among the connecting elements 13, some cause the conductor elements 12 on both sides to be in a conductive condition, and others cause the conductor elements 12 on both sides to be in a non-conductive condition. The switching between the conductive and non-conductive conditions between the conductor elements 12 can be dynamically performed by a switching element.

29 Claims, 32 Drawing Sheets

FOREIGN PATENT DOCUMENTS

| | | | |
|---|---|---|---|
| GB | 2 335 798 | A | 9/1999 |
| JP | 11-266114 | A | 9/1999 |
| WO | WO 01/71849 | A2 | 9/2001 |
| WO | WO 01/80258 | A2 | 10/2001 |

* cited by examiner

*FIG.1*
(a)
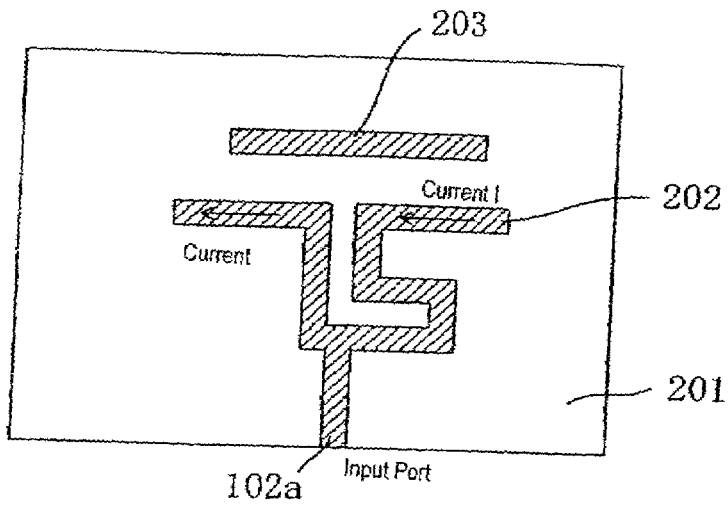
(b)
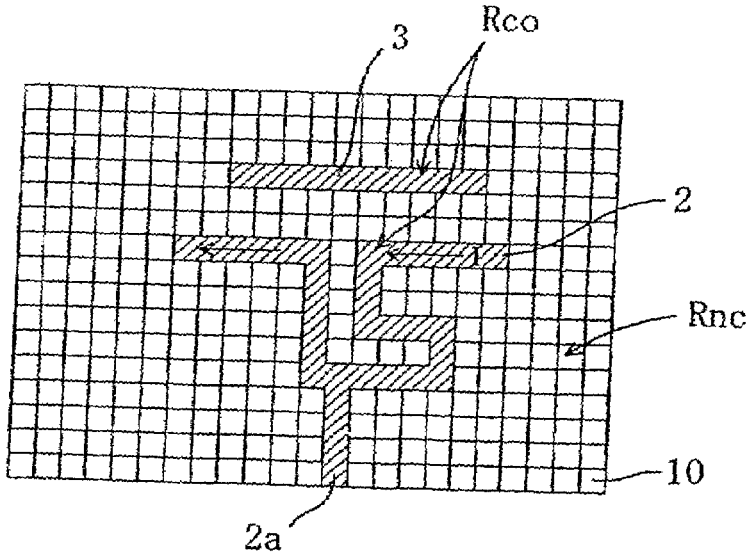

*FIG. 2*
(a)
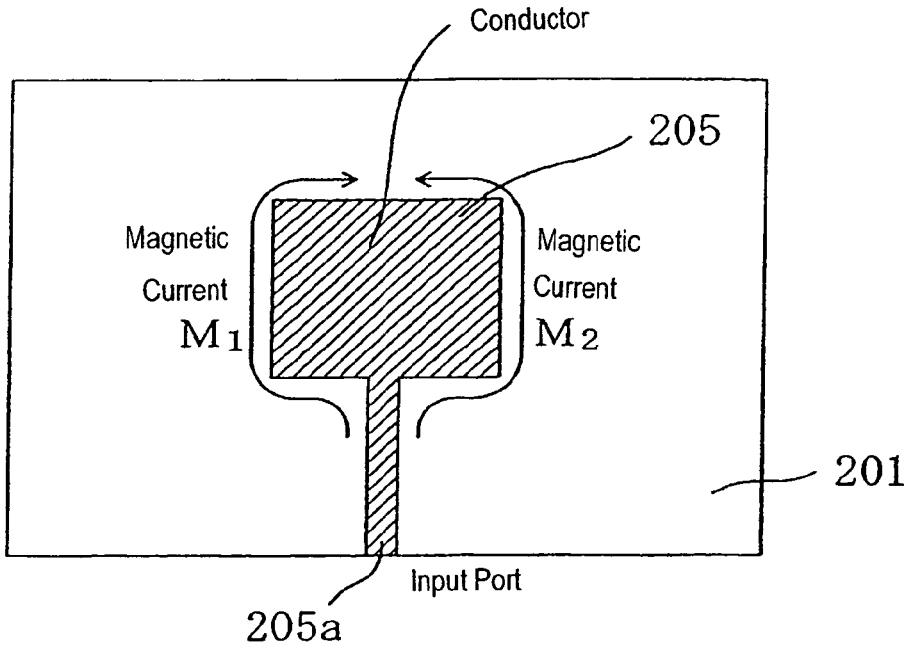
(b)
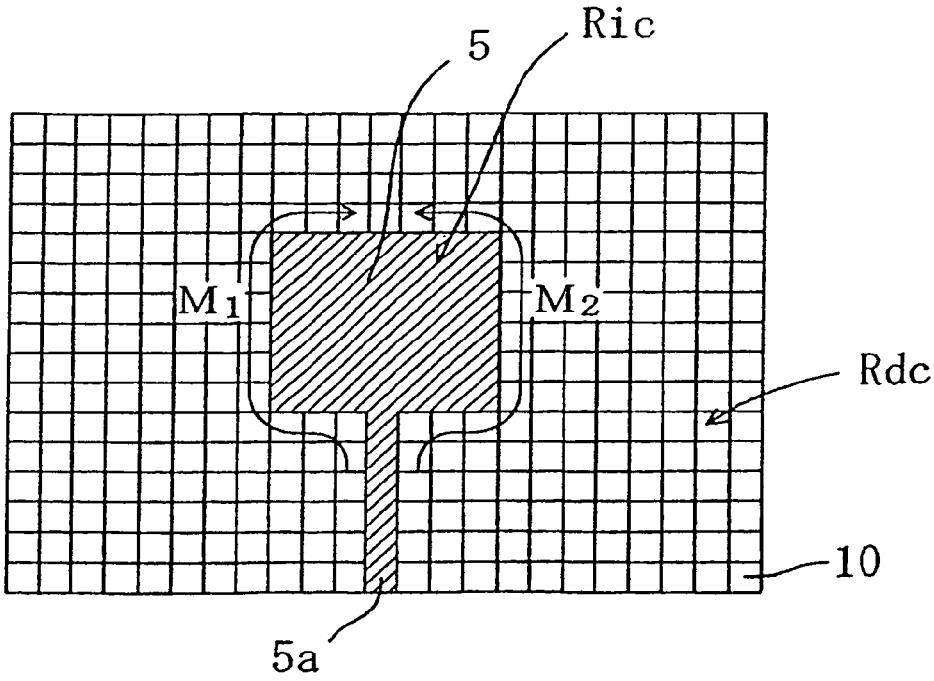

*FIG.13*
(a)
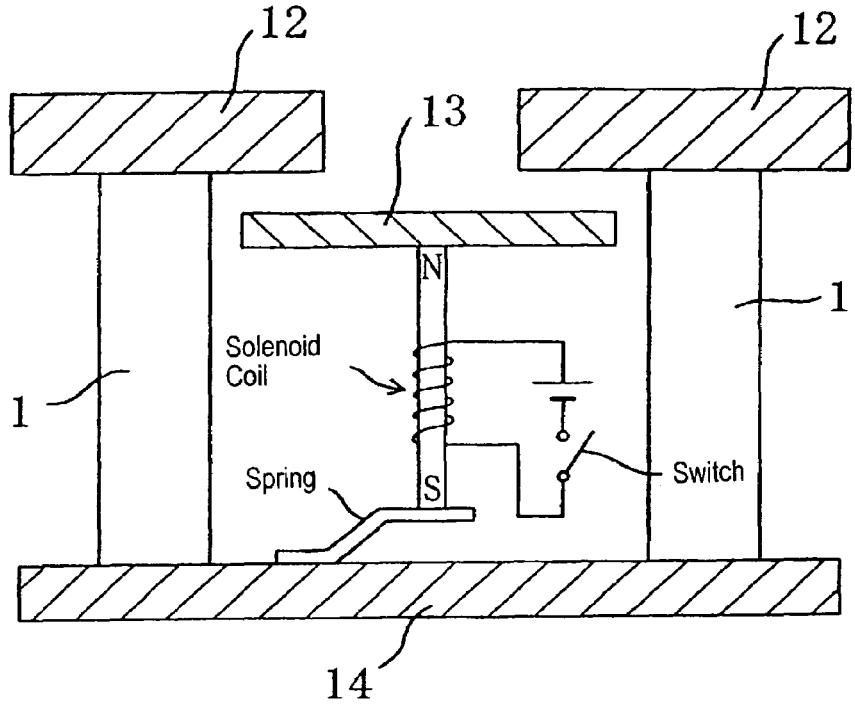
(b)
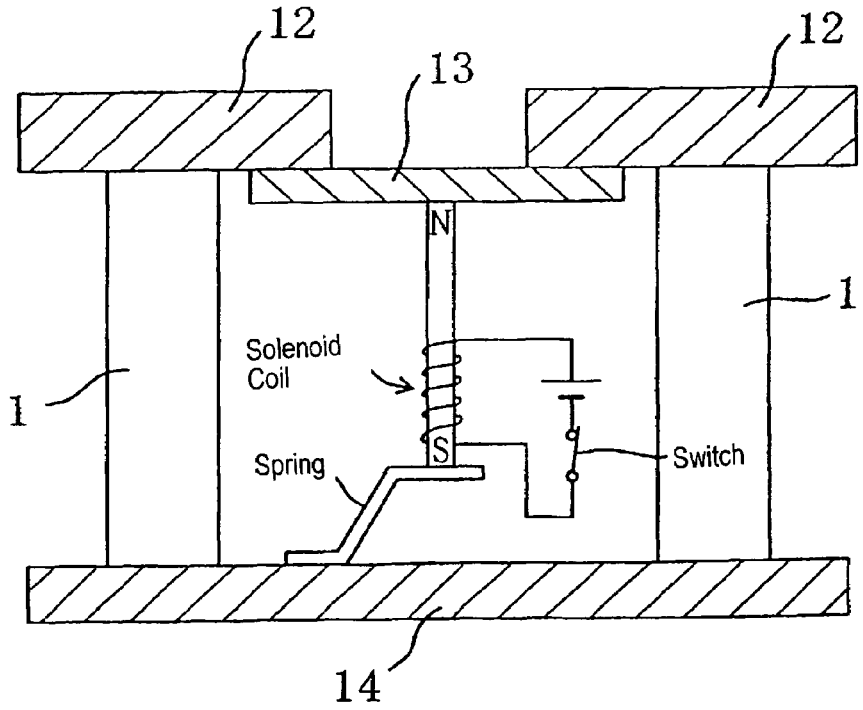

*FIG. 3 0*
| Antenna Form | Directivity | Gain | Impedance |
|---|---|---|---|
| 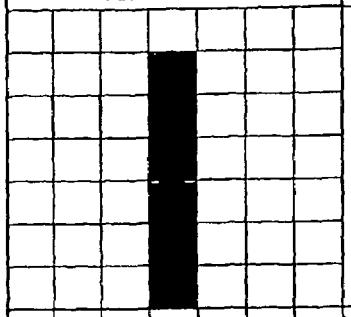 | △ | △ | ○ |
| 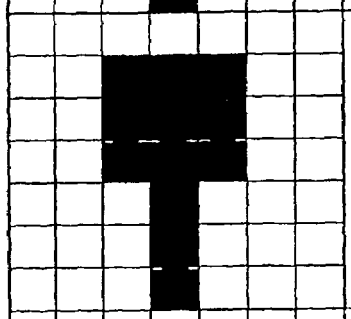 | ○ | ○ | △ |
| 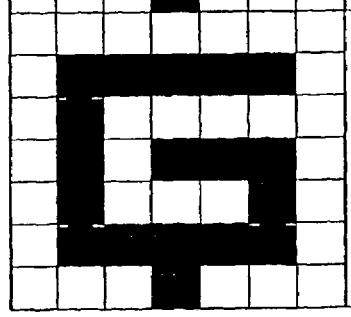 | ◎ | ○ | △ |
*FIG. 3 1*
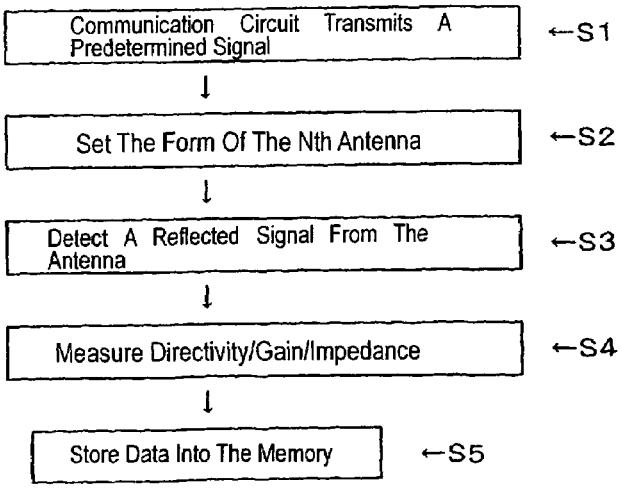

ANTENNA AND APPARATUS PROVIDED WITH THE ANTENNA

CROSS-REFERENCE TO RELATED APPLICATION

This application is a Section 371 of International Application No. PCT/JP02/12612, filed Dec. 2, 2002, the disclosure of which is incorporated herein by reference.

TECHNICAL FIELD

The present invention relates to an antenna used for receiving and transmitting electromagnetic waves such as micro waves and millimeter waves, and particularly to an antenna most suitable for a portable information terminal utilizing radio transmission and for equipment for network (so-called wireless LAN) in a personal computer. The prevent invention also relates to various types of apparatuses provided with the antenna.

BACKGROUND ART

In the fields of television, radio, and the like, various types of antennas are previously developed for receiving or transmitting electromagnetic waves of picture and image signals. The known antennas include an aperture antenna such as a parabolic antenna and a reflective mirror antenna, a linear antenna such as a dipole antenna and a patch antenna, and an array antenna such as a planer antenna and a slot antenna, for example.

For such antennas, a lot of improvements are made mainly for the purposes of improving the factors of directivity, gain, impedance, and the like. The form (topology) and the location of an antenna are designed and determined so that the directivity, gain and impedance are optimized, depending on the frequency of radio wave to be transmitted/received, and the direction from which the radio wave is received.

Recently, in accordance with the developments of portable information terminals utilizing radio transmission and equipment for network (so-called wireless LAN) in personal computers, flexibility is required for the functions of antennas.

Especially in the case where a mobile instrument such as a portable information terminal is used while it is being moved, it may be difficult to carry the radio wave depending on the location, and the power of transmission/reception signals may be weak. Thus, the S/N ratio of the signals may disadvantageously be reduced. In connection with the increase in frequency of electromagnetic waves, a probability that the electromagnetic waves are reflected from an obstruction, thereby causing a so-called multi-pass is increased, and the accuracy of radio communication is degraded.

For the above-described reasons, we require an antenna which can maintain good transmission/receiving characteristics by adapting to any possible change in communication conditions. As the frequency of a signal becomes higher, the directivity of radio wave becomes stronger. Thus, in the case where a number of wireless terminals exist in a communication range, an antenna is required to have a function of realizing communication through a path (an optimum radio path) for effectively communicating with a wireless terminal to be connected.

However, in a conventional antenna, the form of the antenna is fixed, so that the characteristics of the antenna is substantially uniformly determined depending on the predetermined form. Therefore, it is difficult to maintain good transmission/receiving characteristics by adapting to the change in communication conditions. Especially in the case where the frequency of the electromagnetic waves to be handled, and the incident direction of electromagnetic waves are changed, it is difficult to change the antenna characteristics by following the changed conditions.

A main object of the present invention is to provide an antenna capable of dynamically changing the form of an antenna element so as to optimize the parameters of a directivity characteristic, a gain characteristic, an impedance characteristic, and the like of the antenna.

Another object of the present invention is to provide an apparatus provided with such an antenna.

Still another object of the present invention is to provide a producing method and a designing method of an antenna which can determine an optimum form in given conditions by dynamically changing the form of an antenna element.

DISCLOSURE OF INVENTION

The antenna of the present invention includes: an array of a plurality of conductor elements which are mutually separated, and each of which does not independently function as an antenna; and coupling means for electro-magnetically coupling at least two conductor elements selected from the plurality of conductor elements, thereby causing the plurality of coupled conductor elements to function as one antenna element.

In a preferred embodiment, the antenna further includes a dielectric layer for supporting the plurality of conductor elements, wherein the coupling means includes conducting means for electrically connecting the plurality of selected conductor elements.

In a preferred embodiment, the array of the conductor elements includes a matrix portion in which the plurality of conductor elements are arranged in a matrix of rows and columns.

In a preferred embodiment, the matrix portion of the array is constituted by conductor elements having substantially the same shape.

In a preferred embodiment, the matrix portion of the array is constituted by conductor elements having substantially the same size.

In a preferred embodiment, each of the plurality of conductor elements has a size smaller than a wavelength of radio wave to be transmitted and/or received.

In a preferred embodiment, the conducting means includes a group of conductor pieces overlapping at least two adjacent conductor elements, and the conductor pieces are arranged for electrically connecting the selected conductor elements.

In a preferred embodiment, the antenna further includes a dielectric film interposed between the respective conductor elements and the respective conductor pieces.

In a preferred embodiment, the conducting means includes a plurality of switching elements for switching electrically conducting/non-conducting conditions between two conductor elements.

In a preferred embodiment, the plurality of switching elements are arranged in a matrix of rows and columns.

In a preferred embodiment, the antenna further includes a wiring layer for connecting a circuit for driving the plurality of switching elements to the plurality of switching elements.

In a preferred embodiment, the switching elements are transistors.

In a preferred embodiment, the switching element includes a conductor piece which is movably supported, and an actuator for moving the conductor element, and the actuator can reciprocate the conductor piece between a first position in which a plurality of adjacent conductor elements are electrically connected by the conductor piece and a second position in which a plurality of adjacent conductor elements are not electrically connected.

In a preferred embodiment, the dielectric layer has a first main face on which the array of conductor elements is disposed, and a second main face opposite to the first main face, and a grounding conductor is formed on the side of the second main face.

In a preferred embodiment, part of a plurality of conductor elements selected from the plurality of conductor elements function as a grounding conductor.

In a preferred embodiment, the dielectric layer, the conductor elements, and the conducting means are laminated.

In a preferred embodiment, the conducting means is provided in a movable manner, and the antenna further includes a moving mechanism for moving the conducting means between a conducting position in which the at least two conductor elements are made to mutually and effectively conduct, and a non-conducting position other than the conducting position.

In a preferred embodiment, the coupling means includes a conductor layer, and a plurality of dielectric elements disposed between the conductor layer and the respective conductor elements, and the selected conductor elements are more strongly capacitive-coupled to the conductor layer than the conductor elements which are not selected.

In a preferred embodiment, the array of the conductor elements includes a matrix portion in which the plurality of conductor elements are arranged in a matrix of rows and columns.

In a preferred embodiment, the matrix portion of the array is constituted by conductor elements having substantially the same shape.

In a preferred embodiment, the matrix portion of the array is constituted by conductor elements having substantially the same size.

In a preferred embodiment, each of the plurality of conductor elements has a size smaller than a wavelength of radio wave to be transmitted and/or received.

In a preferred embodiment, the dielectric elements positioned between the selected conductor elements and the conductor layer are thinner than the dielectric elements positioned between the conductor elements which are not selected and the conductor layer.

In a preferred embodiment, a specific inductive capacity of the dielectric elements positioned between the selected conductor elements and the conductor layer is larger than a specific inductive capacity of the dielectric elements positioned between the conductor elements which are not selected and the conductor layer.

In a preferred embodiment, the antenna further includes an actuator for moving the conductor elements so as to change a distance between each of the conductor elements and the dielectric layer.

In a preferred embodiment, the dielectric elements and the conductor elements are layered a plurality of times.

The antenna module of the present invention includes: one of the above-described antennas; and a driving circuit for generating a signal for driving the plurality of switching elements.

The apparatus of the present invention includes: one of the above-described antennas; a driving circuit for generating a signal for driving the plurality of switching elements; and control means for controlling the operation of the driving circuit, based on a signal received and/or transmitted by the antenna.

In a preferred embodiment, the apparatus further includes evaluating means for evaluating directivity, gain, and/or impedance of the antenna, based on the signal, wherein conductor elements to be electrically connected are dynamically selected from the plurality of conductor elements, based on the evaluated result.

In a preferred embodiment, the evaluating means evaluates the directivity, gain, and/or impedance of the antenna for each of a plurality of combinations of conductor elements which are electrically and mutually connected by the switching elements.

In a preferred embodiment, the apparatus further includes: a memory for storing the evaluated results for the plurality of combinations of the conductor elements; and a form designing section (topology search section) for selecting conductor elements to be electrically and mutually connected by the switching elements and for controlling the operation of the driving circuit, based on the evaluated results stored in the memory.

The system of the present invention is a system including a plurality of above-described apparatuses, wherein communications are performed between the plurality of apparatuses by radio waves via antennas of the respective apparatuses, and connection patterns of the plurality of conductor elements are dynamically changed for defining forms of the antennas of the respective apparatuses.

The production method of the present invention is a production method of an apparatus provided with an antenna includes: a step of forming an array of a plurality of conductor elements used for forming a conductor pattern defining a form of the antenna, the plurality of conductor elements being mutually separated; and a step of forming conducting means for selectively and mutually connecting some of the plurality of conductor elements, thereby determining the conductor pattern.

The designing method of the present invention is a form designing method (topology searching method) of an antenna in an apparatus provided with the antenna including a step (a) of forming an array of a plurality of conductor elements used for forming a conductor pattern defining a form of the antenna, the plurality of conductor elements being mutually separated; a step (b) of selecting desired conductor elements from the plurality of conductor elements, and for electrically and mutually connecting the selected conductor elements; and a step (c) of transmitting and/or receiving radio waves by using the conductor elements which are electrically and mutually connected, and for evaluating directivity, gain, and/or impedance of the antenna, wherein the steps (b) and (c) are repeatedly performed for different combinations of the conductor elements to be selected.

BRIEF DESCRIPTION OF THE DRAWINGS

FIG. 10 is a sectional view showing a second embodiment of the antenna according to the present invention.

FIG. 11 is a sectional view showing a current flowing in the antenna of FIG. 10.

FIGS. 13(*a*) and 13(*b*) are sectional views showing a first example of conducting means in the third embodiment of the antenna according to the present invention, respectively.

FIGS. 15(*a*) and 15(*b*) are sectional views showing a third example of conducting means in the third embodiment of the antenna according to the present invention, respectively.

FIG. 20(*a*) is a sectional view of an antenna in which first dielectric elements having a larger area exist under conductor elements on both ends among three conductor elements,- and a second dielectric element having a smaller area exists under the center conductor element 12, and FIG. 20(*b*) is a plan view thereof.

FIG. 21(*a*) is a sectional view of a planer antenna in which three first dielectric elements exist under three conductor elements, and FIG. 21(*b*) is a plan view thereof.

FIG. 22(*a*) is a sectional view of an antenna in which first dielectric elements having higher dielectric constant $\in$1 exist under conductor elements on both ends, and a second dielectric element having lower specific dielectric constant $\in$2 exists under a center conductor element, and FIG. 22(*b*) is a plan view thereof.

FIG. 23(*a*) is a sectional view of a planer antenna in which three first dielectric elements exist under three conductor elements, and FIG. 23(*b*) is a plan view thereof.

FIG. 24(*a*) is a sectional view of an antenna in which first dielectric elements having higher averaged specific inductive capacity exist under conductor elements on both ends, and a second dielectric element having lower averaged specific inductive capacity exists under a center conductor element, and FIG. 24(*b*) is a plan view thereof.

FIG. 25(*a*) is a sectional view of a planer antenna in which three conductor elements are in contact with dielectric elements, respectively, and FIG. 25(*b*) is a plan view thereof.

FIG. 26(*a*) is a sectional view of an antenna in which conductor elements on both ends are in contact with dielectric elements, but a center conductor element center is separated from a dielectric element, and FIG. 26(*b*) is a plan view thereof.

FIG. 27 is a perspective view showing a horn antenna according to the present invention.

FIG. 28 is a perspective view showing a slot antenna according to the present invention.

FIG. 29 is a block diagram showing an embodiment of an apparatus provided with the antenna of the present invention.

FIG. 30 is a chart showing an example of a relationship between an antenna form, and directivity and the like.

FIG. 31 is a flow chart showing an example of a procedure for measuring directivity, gain, and impedance of an antenna, by changing the form of the antenna.

FIG. 32 is a block diagram showing another embodiment of an apparatus provided with the antenna of the present invention.

FIG. 33 is a block diagram showing still another embodiment of an apparatus provided with the antenna of the present invention.

FIG. 34 is a block diagram showing still another embodiment of an apparatus provided with the antenna of the present invention.

FIG. 35 is a block diagram showing still another embodiment of an apparatus provided with the antenna of the present invention.

FIG. 36 is a perspective view showing an example of an antenna module in which the antenna of the present invention and a circuit for controlling the form of the antenna are integrally provided.

FIGS. 37(*a*) to 37(*c*) are perspective views schematically showing the fact that the directivity is changed due to the change in the form of the antenna.

FIG. 40 is a block circuit diagram showing the internal constitution of the base station in more detail.

BEST MODES FOR CARRYING OUT THE INVENTION

[Antenna of Current Control Type]

Figure 1:
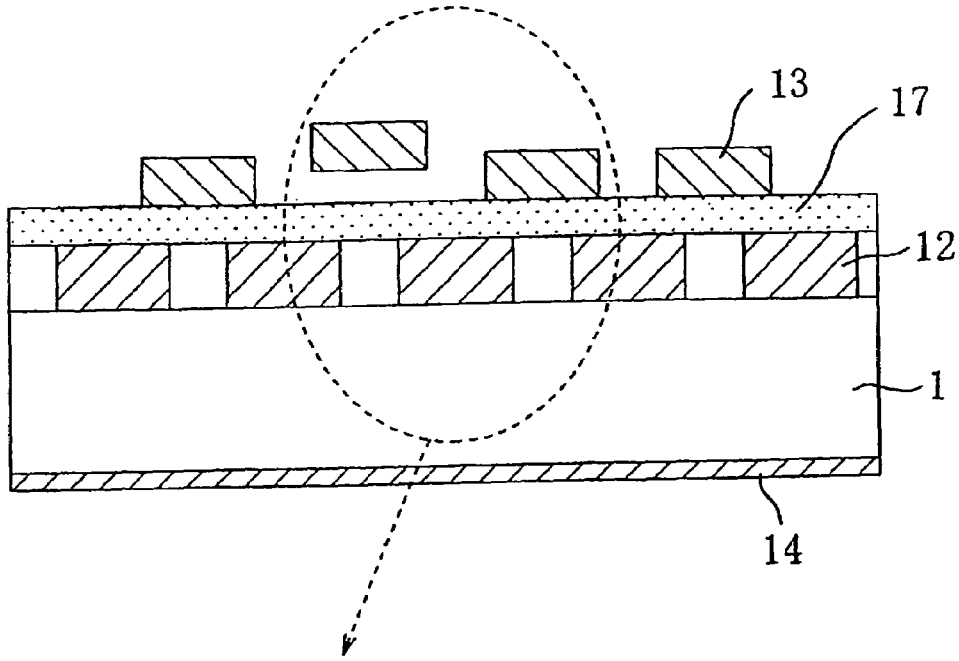
FIG. 1(*a*) is a plan view showing an exemplary configuration of a conventional planer antenna of current control type, and FIG. 1(*b*) is a plan view showing an exemplary configuration of a planer antenna of current control type according to the present invention.
Figure 1:
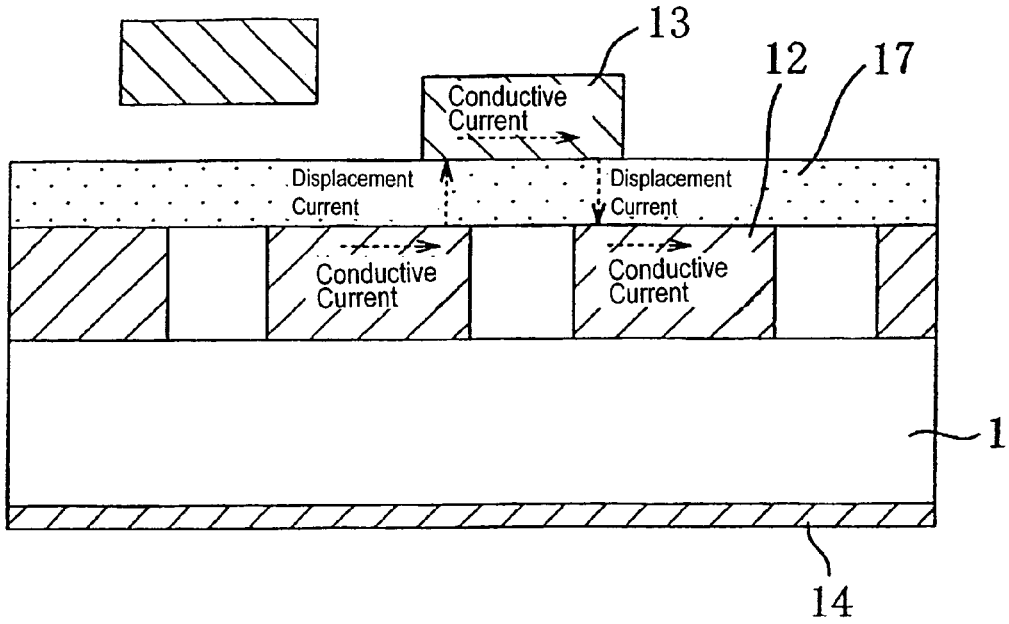

First, with reference to FIGS. 1(*a*) and 1(*b*), fundamental characteristics of an antenna according to the present invention will be described. Herein, the antenna of "current control type" is described. FIG. 1(*a*) shows an exemplary configuration of a conventional planer antenna of current control type, and FIG. 1(*b*) shows an exemplary configuration of a planer antenna of current control type according to the present invention.

In this specification, the term "an antenna of current control type" indicates an antenna of which the form is designed significantly in view of the current (electric field) distribution. Other than the antenna of current control type, there is an antenna of magnetic current control type. The term "an antenna of magnetic current control type" indicates an antenna of which the form is designed significantly in view of the magnetic current (magnetic field) distribution.

The conventional planer antenna of current control type includes, as shown in FIG. 1(*a*), a dielectric substrate 201, and conductors 202 and 203 having specified patterns formed on the dielectric substrate 201. The conductors. 202 and 203 are formed by depositing a metal layer on a dielectric substrate 1, and then removing unnecessary portions of the metal layer, for example.

In the example shown in the figure, an end portion 102*a* of the conductor 202 functions as an input port for an input signal into equipment in reception, and functions as an output port for an output signal from the equipment to the external in transmission.

In the above-described prior-art example, a conductor pattern is previously designed so as to obtain desired antenna characteristics, and the form of the conductors 202 and 203 is fixed on the dielectric substrate 201. Thereof, it is extremely difficult to change the form of the conductors 202 and 203.

On the other hand, the planer antenna of current control type according to the present invention has a cell array structure in which a lot of unit cells 10 are arranged in rows and columns, for example. The respective unit cells 10 are separated, but a group of unit cells selected from the cell array are made to be interconnected by conducting means which is not shown in FIG. 1(*b*), so as to form conductors 2 and 3 having a form which functions as an antenna.

In the example shown in FIG. 1(*b*), the unit cells positioned in a conductive region Rco are interconnected. On the other hand, a group of unit cells 10 which are not selected from the cell array (a unit cell group in a non-conductive region Rnc) are not interconnected at all, or are hardly interconnected. The group of unit cells 10 which are not selected (the unit cell group in the non-conductive region Rnc) is left on the dielectric substrate, and it is unnecessary to remove the group. This is because a size of each of the isolated unit cells 10 is smaller than the wavelength of electromagnetic waves, so that the isolated unit cells do not function substantially as part of antenna.

In the example shown in FIG. 1(*a*), an end portion 2*a* of the conductor 2 functions as an input port for an input signal into equipment in reception, and functions as an output port for an output signal from the equipment to the external in transmission.

In this invention, after it is determined which unit cells 10 are selected from the array of the unit cells 10, the selected unit cells 10 are electrically interconnected by conducting means. In a preferred embodiment of the invention, the unit cells 10 that are not electrically interconnected to any other unit cells 10 at a certain point in time (not-selected unit cells) are not removed, and are left on the dielectric substrate. Therefore, in a next occasion, the unit cells 10 can be selected and electrically interconnected to other unit cells 10 by the conducting means.

As described above, according to the antenna of the present invention, the pattern (the form) of an element functioning as an antenna (an antenna element) can be adjusted.

Generally, when an antenna of current control type is to be designed, the shape of the antenna element is determined so as to obtain a current pattern corresponding to desired antenna characteristics. In addition to the conductor pattern, a combination pattern of conductor and dielectric may function as an antenna. That is, the current flowing through the conductor finally becomes an input signal into the equipment, but the electromagnetic waves pass also through the dielectric, and the characteristics of the dielectric affect the current flowing through the conductor. Therefore, the elements constituting the antenna are both of the conductor and the dielectric. However, when a material having an extremely small dielectric constant such as an air exists between conductors, the influence by the material on the electromagnetic waves can be neglected, insofar as the conductors are disposed not in close proximity to each other. For this reason, only the conductor pattern is dealt as a pattern of antenna element, for convenience.

Hereinafter fundamental differences between the antenna of the present invention and the conventional antenna will be described in more detail.

The conventional antenna of current control type shown in FIG. 1(*a*) is a planer antenna. Irrespective of the planer type or not, conventionally, the conductor pattern or the combination pattern of conductor and dielectric functioning as an antenna is almost uniquely determined in accordance with the equipment to which the antenna is attached.

In general, depending on the direction and the frequency band of electromagnetic waves to be received, a preferable shape of the conductor portion functioning as an antenna is varied. Accordingly, in the case of an antenna in which the shape of the conductor portion was not dynamically changed (reconstructed), in order to address the change in the direction of electromagnetic waves to be received, it was necessary to change the direction of the antenna. In addition, in the case where the frequency band of the electromagnetic waves to be received is changed, a plurality of kinds of antennas corresponding to the respective frequency bands were previously prepared, and the antenna to be used was required to be switched from a certain antenna to another antenna in accordance with the change in the frequency band of electromagnetic waves.

On the contrary, in the antenna of current control type according to the present invention, it is possible to realize a wide variety of conductor patterns or combination patterns of conductor and dielectric only by changing the selection of unit cells 10 shown in FIG. 1(*b*) to be electrically connected.

For example, in the case where an antenna is attached to a portable information terminal in a room, an optimum form of an antenna element is varied depending on the extent of the room, and the kinds and sizes of apparatuses placed in the room. In accordance with the variation, the selection of unit cells 10 incorporated in the conductive region Rco in the cell array shown in FIG. 1(*b*) is changed, so that the conductor pattern (or the combination pattern of conductor and dielectric) for defining the form of the antenna can be changed to be optimum.

[Antenna of Magnetic Current Control Type]

Figure 2:
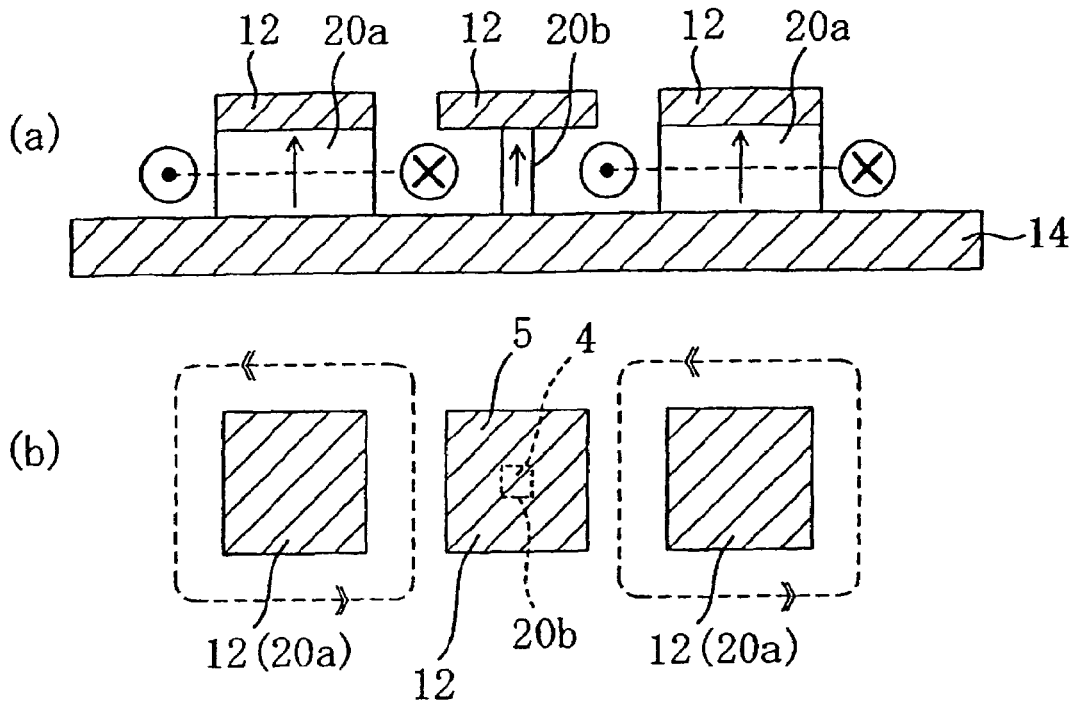
FIG. 2(*a*) is a plan view showing an exemplary configuration of a conventional planer antenna of magnetic current control type, and FIG. 2(*b*) is a plan view showing an exemplary configuration of a planer antenna of magnetic current control type according to the present invention.
Figure 2:
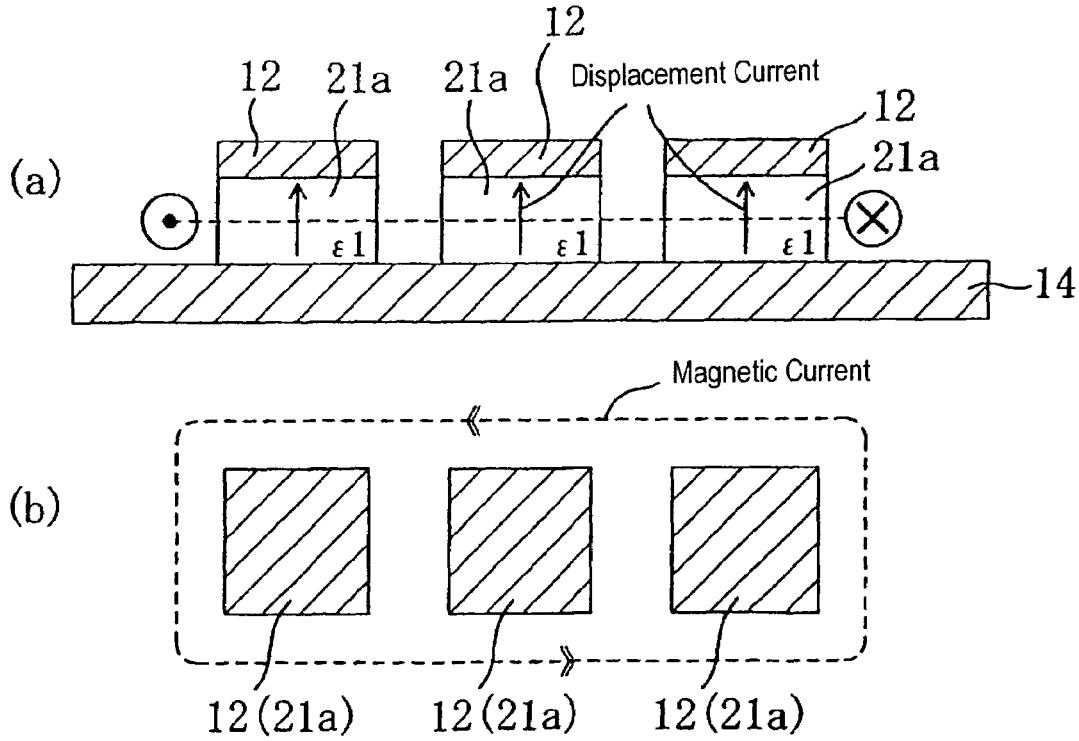
Figure 2:
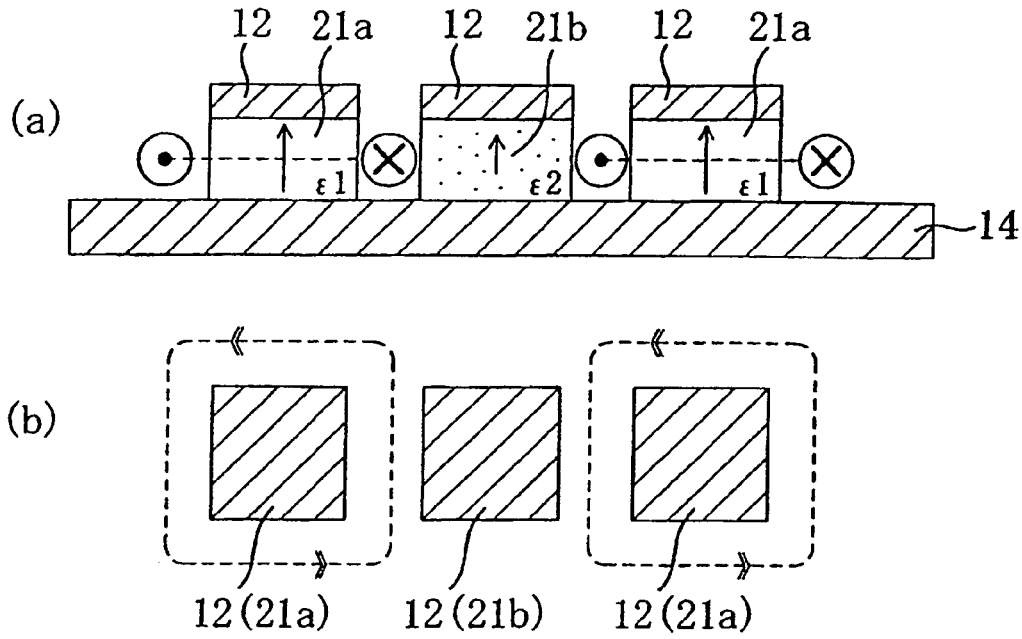
Figure 2:
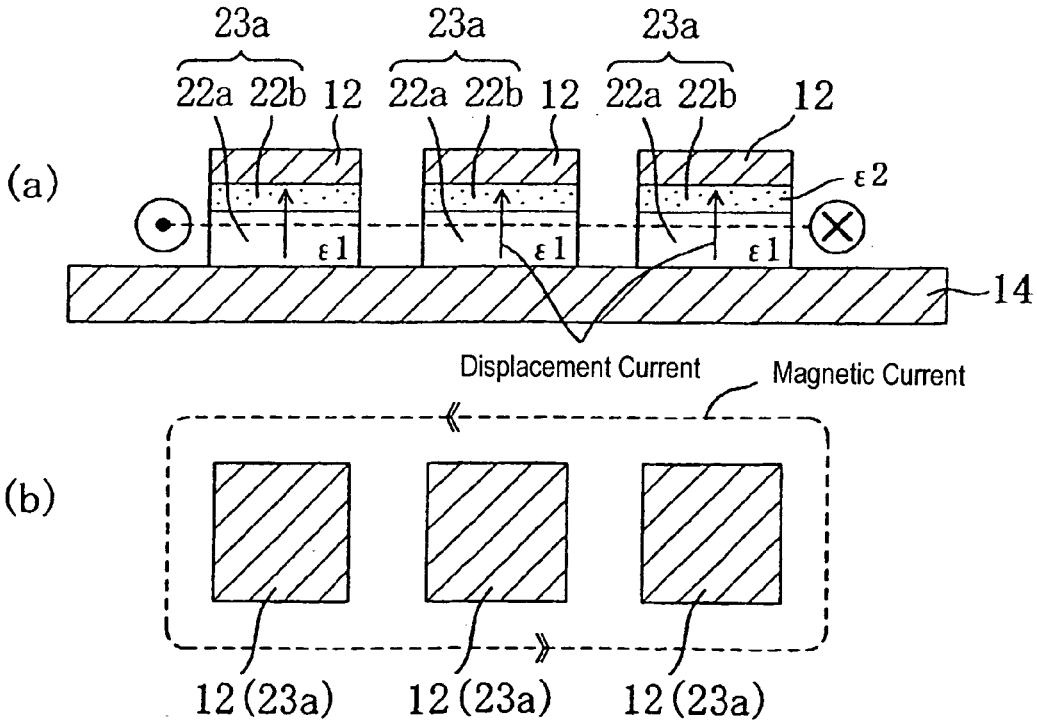
Figure 2:
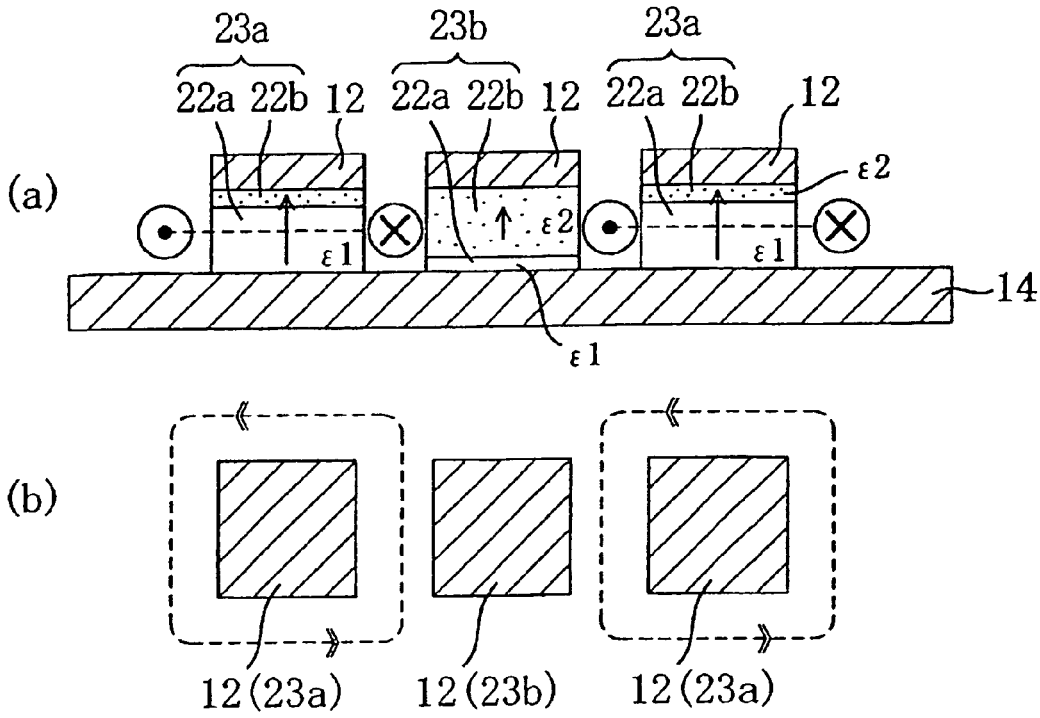
Figure 2:
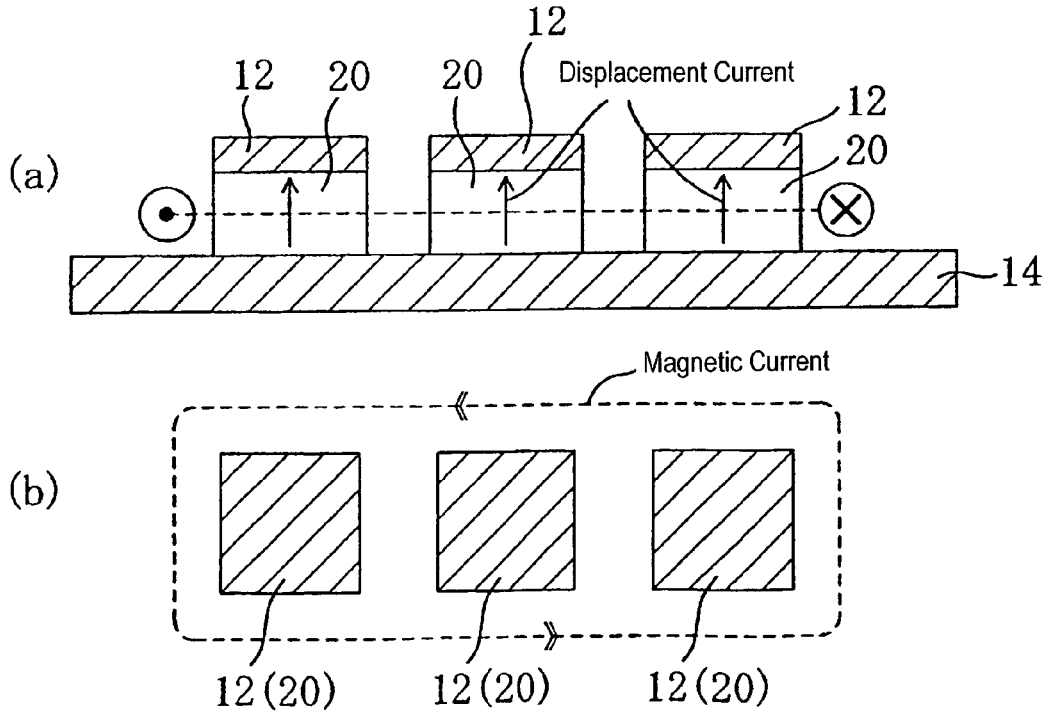
Figure 2:
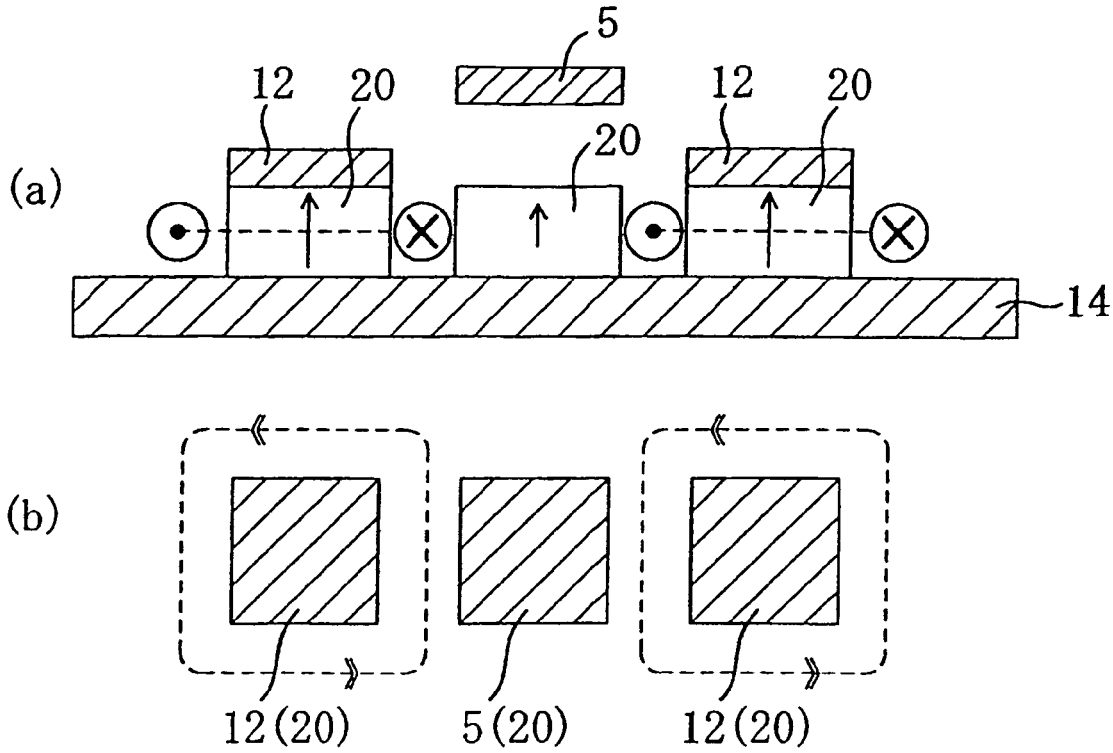
Figure 2:
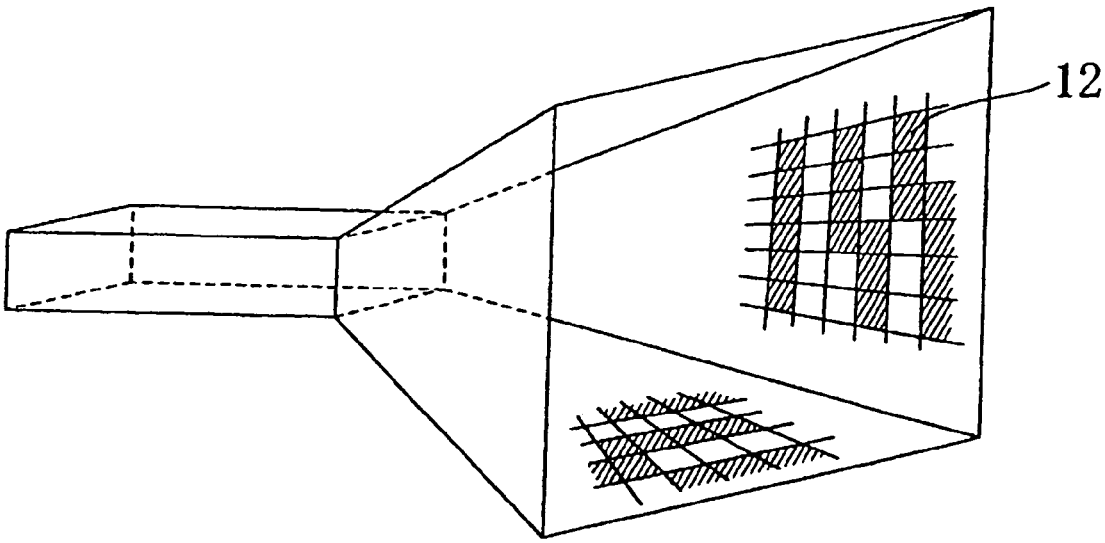
Figure 2:
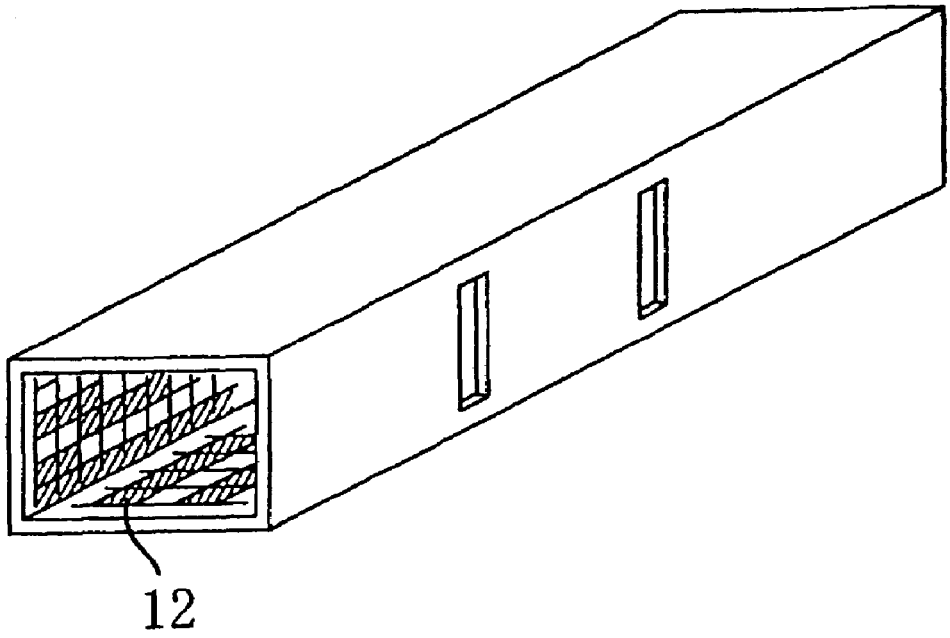
Figure 2:
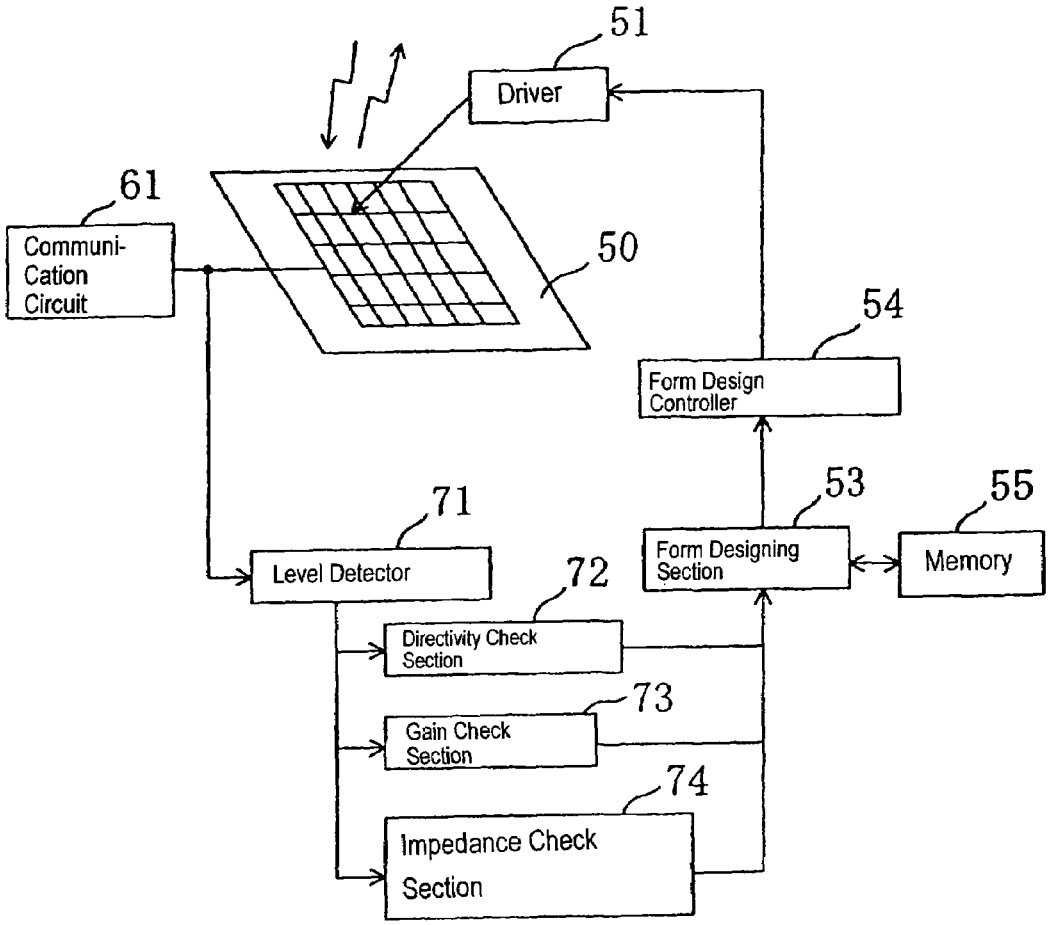
Figure 3:
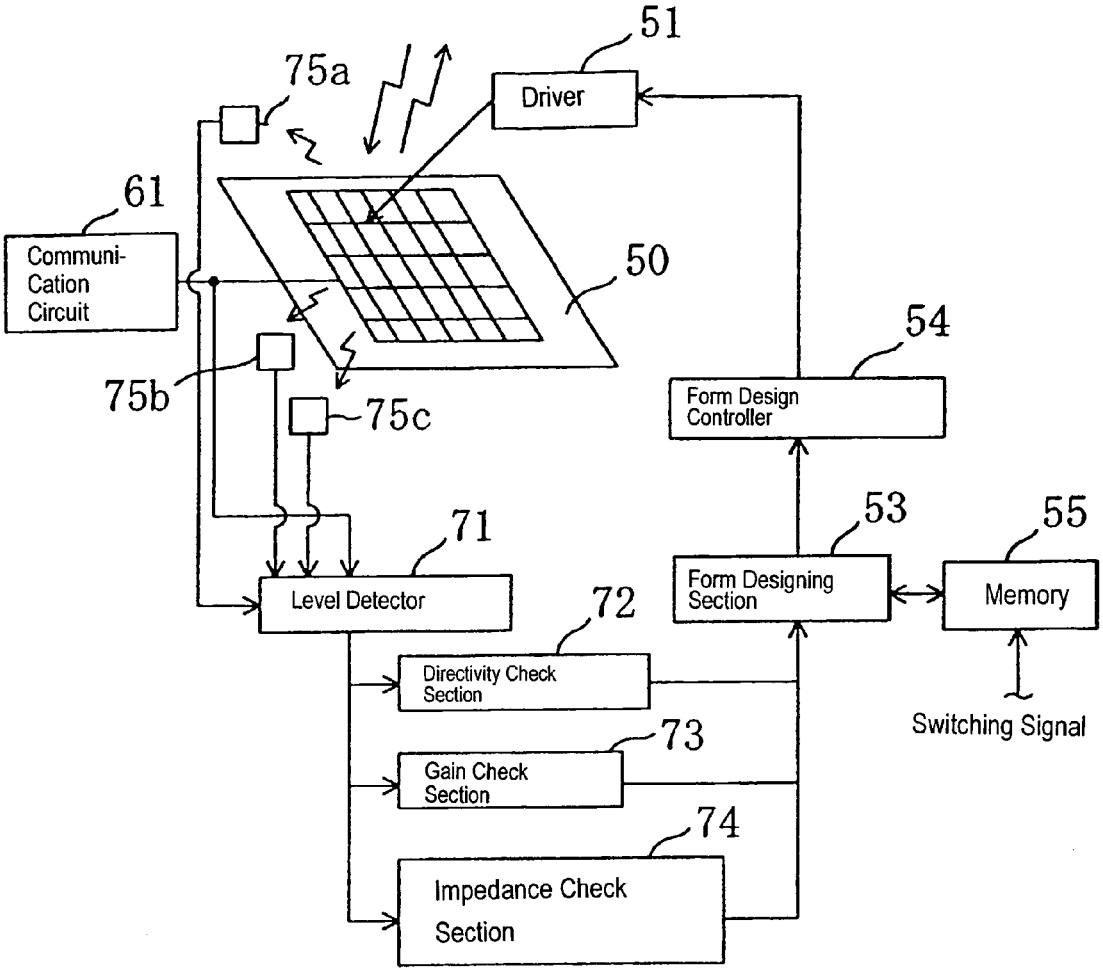
Figure 3:
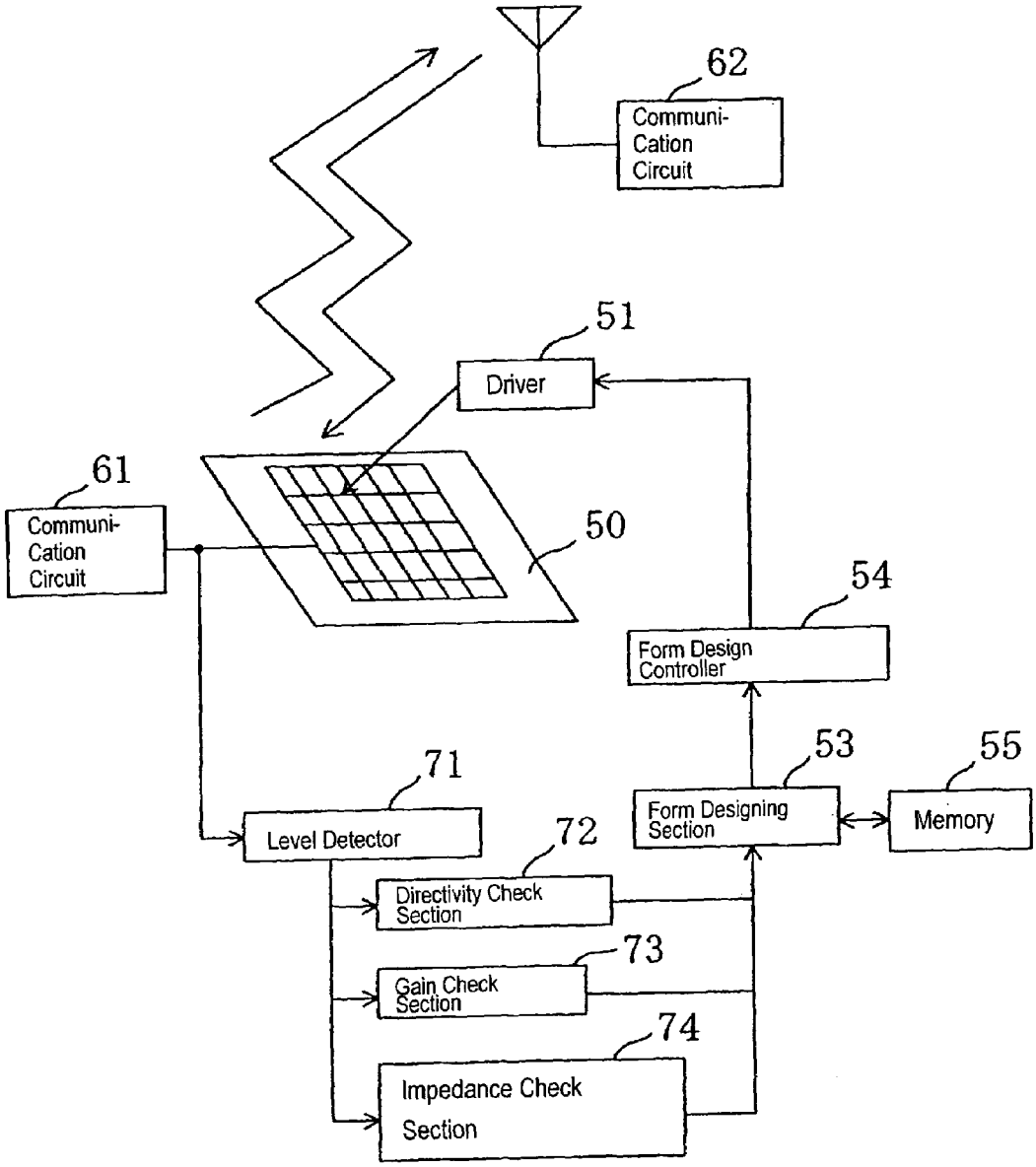
Figure 3:
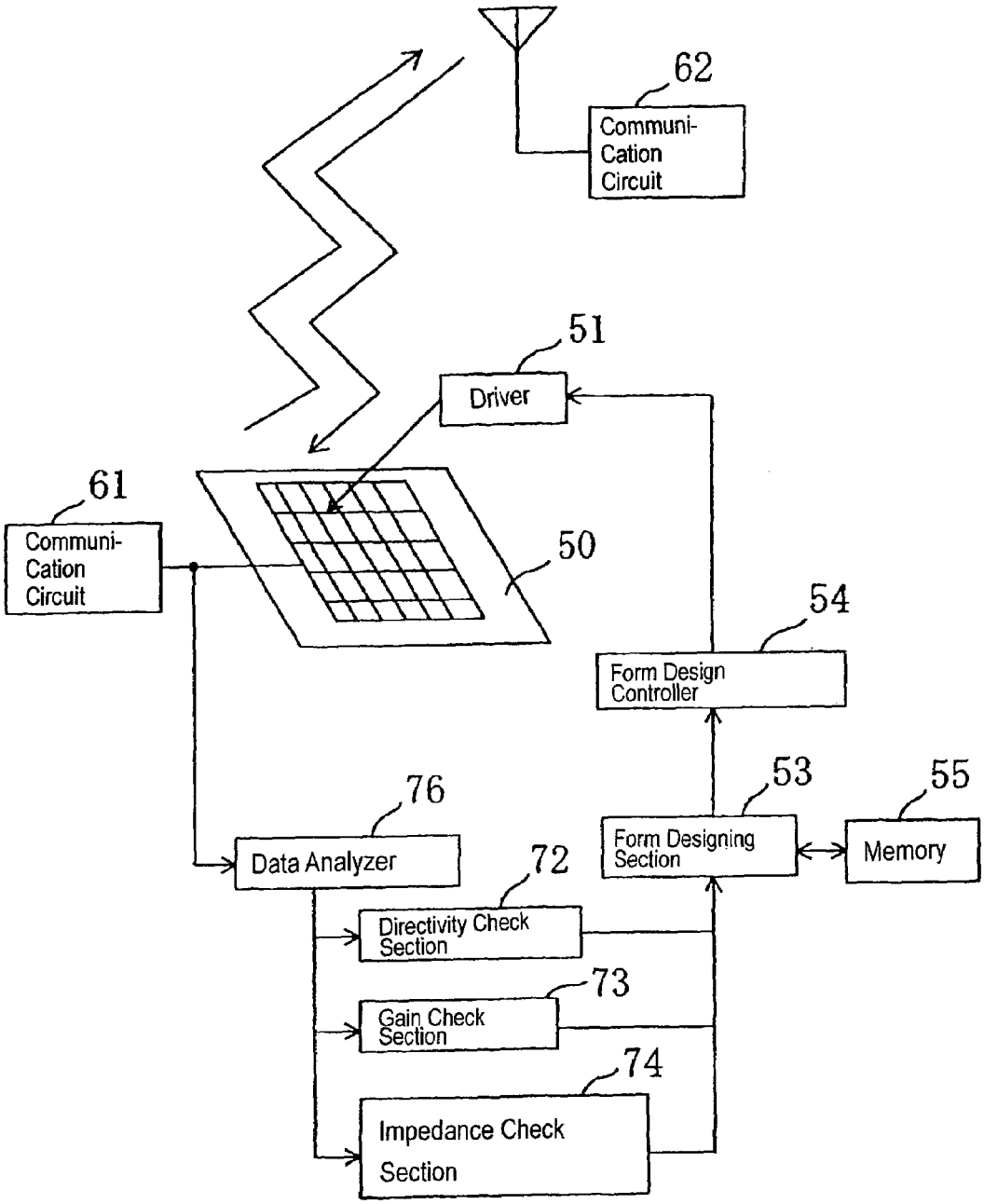
Figure 3:
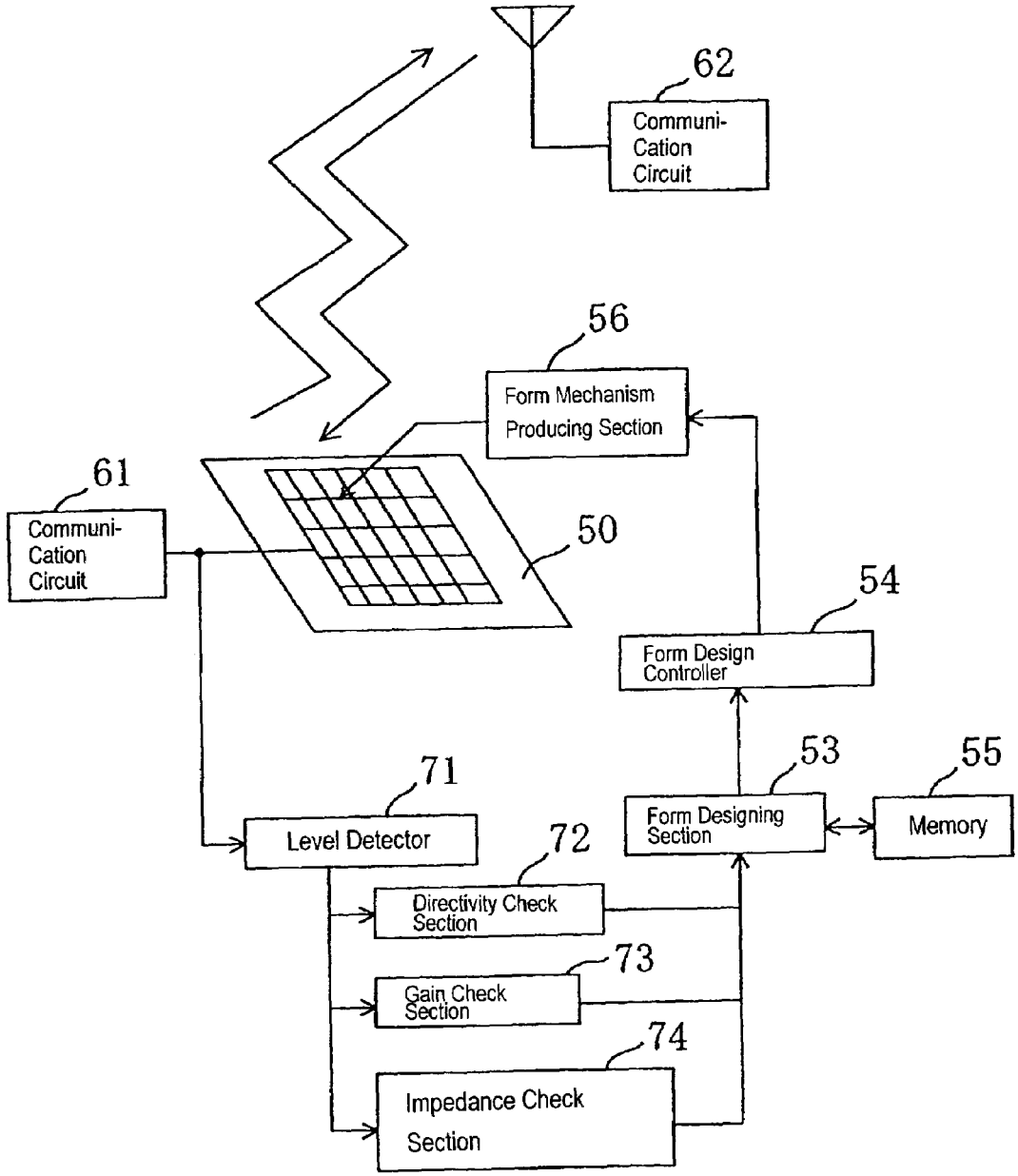
Figure 3:
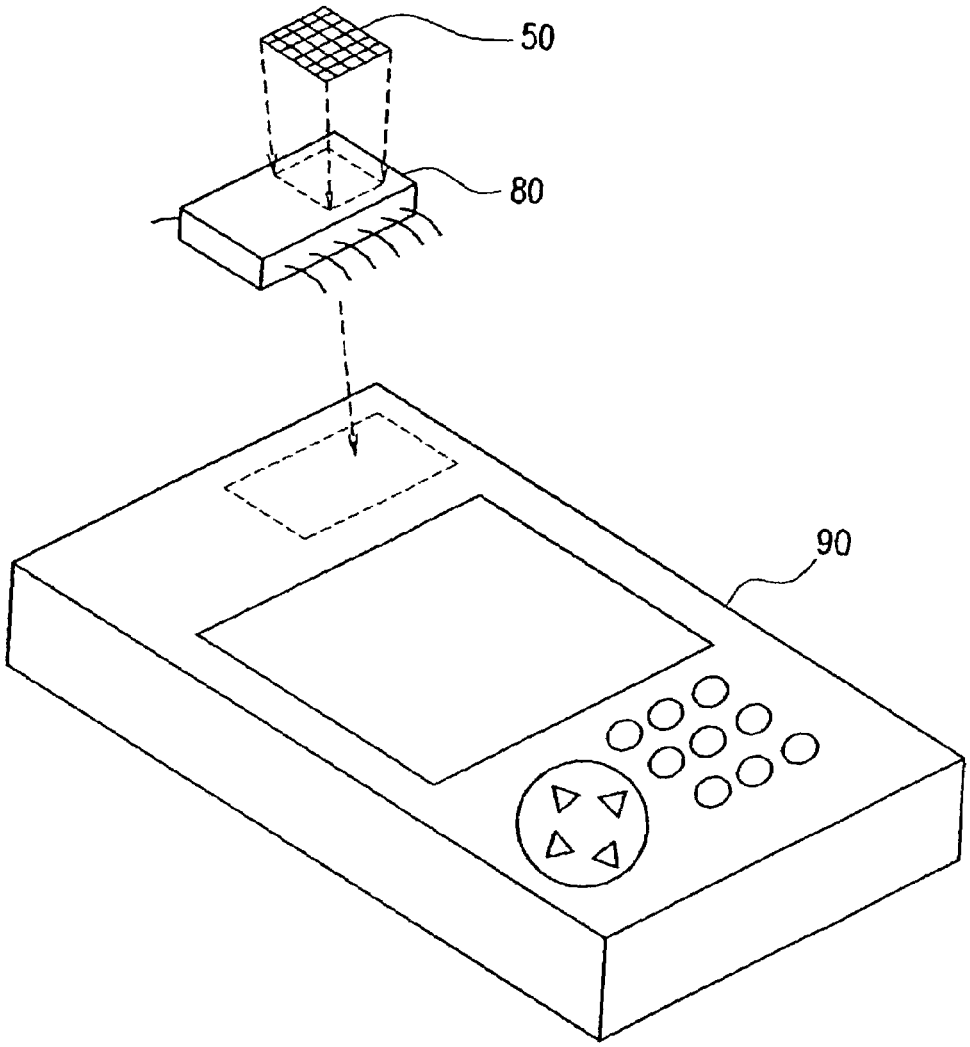
Figure 3:
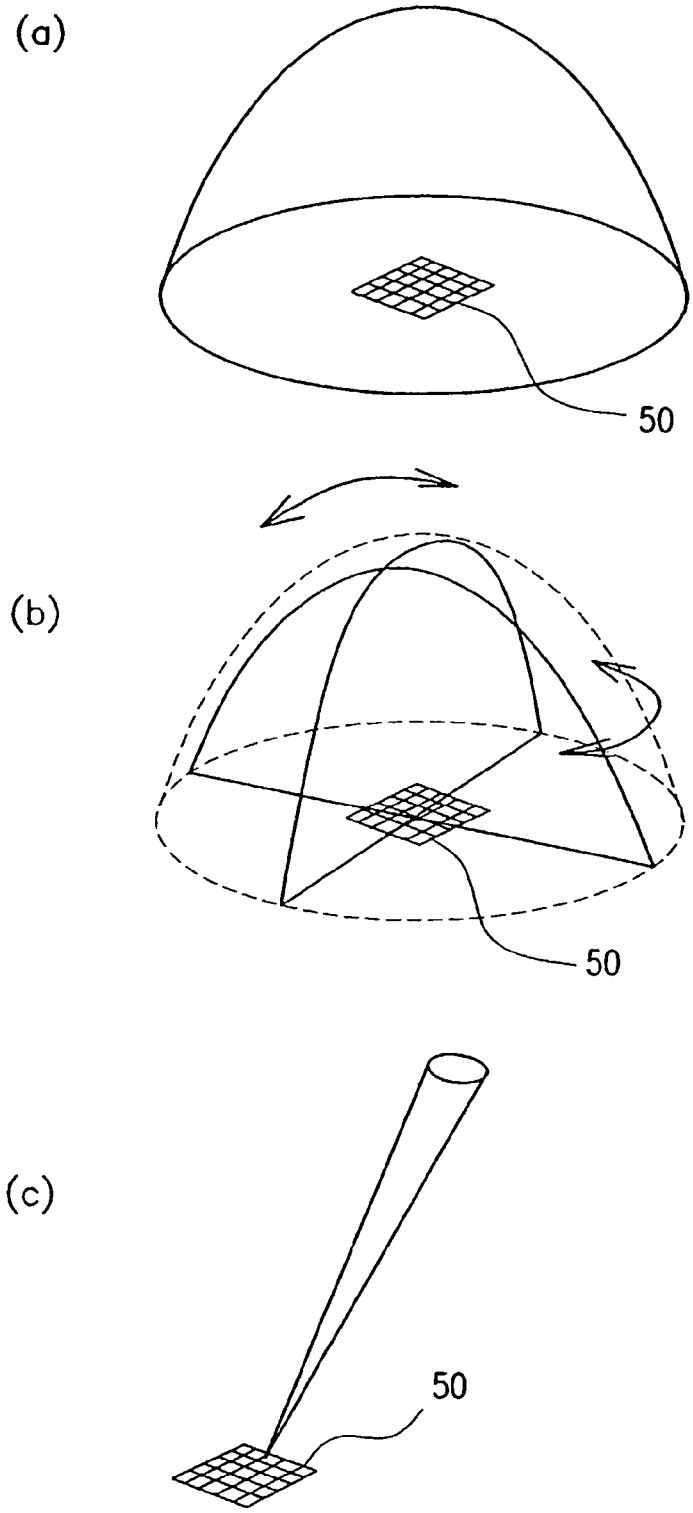

Next, a planer antenna of magnetic current control type is described. FIG. 2(*a*) shows an exemplary configuration of a conventional planer antenna of magnetic current control type. FIG. 2(*b*) shows an exemplary configuration of a planer antenna of magnetic current control type according to the present invention.

The conventional planer antenna of magnetic current control type includes, as shown in FIG. 2(*a*), a dielectric substrate 201, a conductor 205 formed on the dielectric substrate 201. An end portion 205*a* of the conductor 205 functions as an input port for an input signal into equipment in reception, and functions as an output port for an output signal from the equipment to the external in transmission. In the case of the magnetic current control type, the conductor pattern is designed so as to obtain a magnetic current corresponding to desired antenna characteristics. Similarly to the antenna shown in FIG. 1(*a*), the conductor 205 is formed from a continuous metal layer, so that it is difficult to change the shape thereof.

On the other hand, the planer antenna of the magnetic current control type according to the present invention has, as shown in FIG. 2(*b*), a cell array structure in which a large number of unit cells 10 are arranged in rows and columns, for example. Unit cell groups in the cell array (unit cell groups in a larger capacity region Ric) are made to be mutually conductive, so that it is easy to form a conductor 5 having a desired shape. Unit cell groups which are not selected from the cell array (unit cell groups in a smaller capacity region (Rdc) are not conductive at all, or hardly conductive. An end portion 5*a* of the conductor 5 functions as an input port for an input signal into equipment in reception, and functions as an output port for an output signal from the equipment to the external in transmission.

The term "magnetic current" does not physically exist. In the case where an electromagnetic field of high frequencies is studied, the term is supposed as a concept corresponding to an "electric current". An oscillating condition of electric charges with respect to an electric field which temporally varies can be expressed as the "electric current". Similarly, an oscillating condition of magnetic charges (or magnetization) with respect to a magnetic field which temporally varies can be grasped as the "magnetic current".

In the antenna of magnetic current control type according to the present invention, similarly to the above-described antenna of current control type of the present invention, a pattern of element functioning as an antenna (antenna element) can be easily changed. In the antenna of magnetic current control type, however, the pattern of antenna element is adjusted so as to obtain a magnetic current pattern in accordance with the desired antenna characteristics.

In the antenna of magnetic current control type, similarly to the antenna of current control type of the present invention, not only the conductor pattern, but also a combination pattern of conductor and dielectric can function as an antenna. However, a conductor pattern exists in materials having extremely small dielectric constants such as an air, the influence of the materials on electromagnetic waves can be almost neglected. Thus, only the conductor pattern is dealt as the pattern of antenna element, for convenience.

In the conventional antenna of magnetic current control type, as shown in FIG. 2(*a*), the conductor pattern functioning as an antenna (or a combination pattern of conductor and dielectric) is determined almost uniquely in accordance with an apparatus to which the antenna is attached.

On the contrary, in the antenna of magnetic current control type of the present invention, as shown in FIG. 2(*b*), a conductor pattern or a combination pattern of conductor and dielectric in accordance with the change of a wide variety of electromagnetic waves can be easily realized. For example, in the case where an antenna is attached to a portable information terminal in a room, an optimum antenna element pattern is varied depending on the extent of the room, and the kinds and sizes of apparatuses placed in the room. According to the present invention, the selection of unit cells 10 incorporated in the larger capacity region Ric in the cell array shown in FIG. 2(*b*) is changed, so that the conductor pattern can be changed to be optimum. A difference from the antenna of current control type is in that a magnetic current flowing through a conductor pattern is used as a parameter for judging whether an optimum pattern is realized or not in the antenna of magnetic current control type.

Generally, the antenna of current control type is configured so as to oscillate an electric field, and the antenna of magnetic current type is configured so as to oscillate a magnetic field. However, in actuality, when the electric field is oscillated, the magnetic field is also oscillated in some degree, and when the magnetic field is oscillated, the electric field is also oscillated in some degree. Therefore, one antenna may be regarded as an antenna of current control type and an antenna of magnetic current control type.

In the antenna of current control type, when the magnitude and the pattern of a current flowing through the antenna element are determined, the magnitude and the pattern of a magnetic current are accordingly determined. On the contrary, in the antenna of magnetic current control type, when the magnitude and the pattern of a magnetic current flowing through the antenna element are determined, the magnitude and the pattern of a current are accordingly determined. In other words, if either one of the current or the magnetic current caused in the antenna element due to the transmission or the reception of electromagnetic waves is controlled, the other one is also controlled. Therefore, antennas are classified into an antenna of current control type and an antenna of magnetic current control type, depending on the judgment which is more convenient, the current or the magnetic current to be used as a parameter for controlling the pattern of the antenna element, for convenience. However, these antennas are not substantially different.

The shape of the conductor portion in the antenna of the invention is changed automatically by the equipment to which the antenna is attached, and also changed by a user as needed. In some cases, a manufacturer may prepare the cell array constituted by a number of unit cells 10 shown in FIG. 1(*b*) and FIG. 2(*b*), and flexibly adjust the form of the antenna element in assembling or shipping of the product so that the kind of equipment in which the antenna is used is suitable for the service conditions.

The antenna of the present invention is not limited to the planer antenna. For example, a pattern of an antenna element of an aperture antenna or a linear antenna can be controlled. Alternatively, the antenna shown in FIG. 1(*b*) or FIG. 2(*b*) can be used as part of an aperture antenna, a linear antenna, or a slot antenna.

[Embodiments of Antenna]

Hereinafter embodiments of the antenna according to the present invention will be described.

(First Embodiment)

Figure 3:
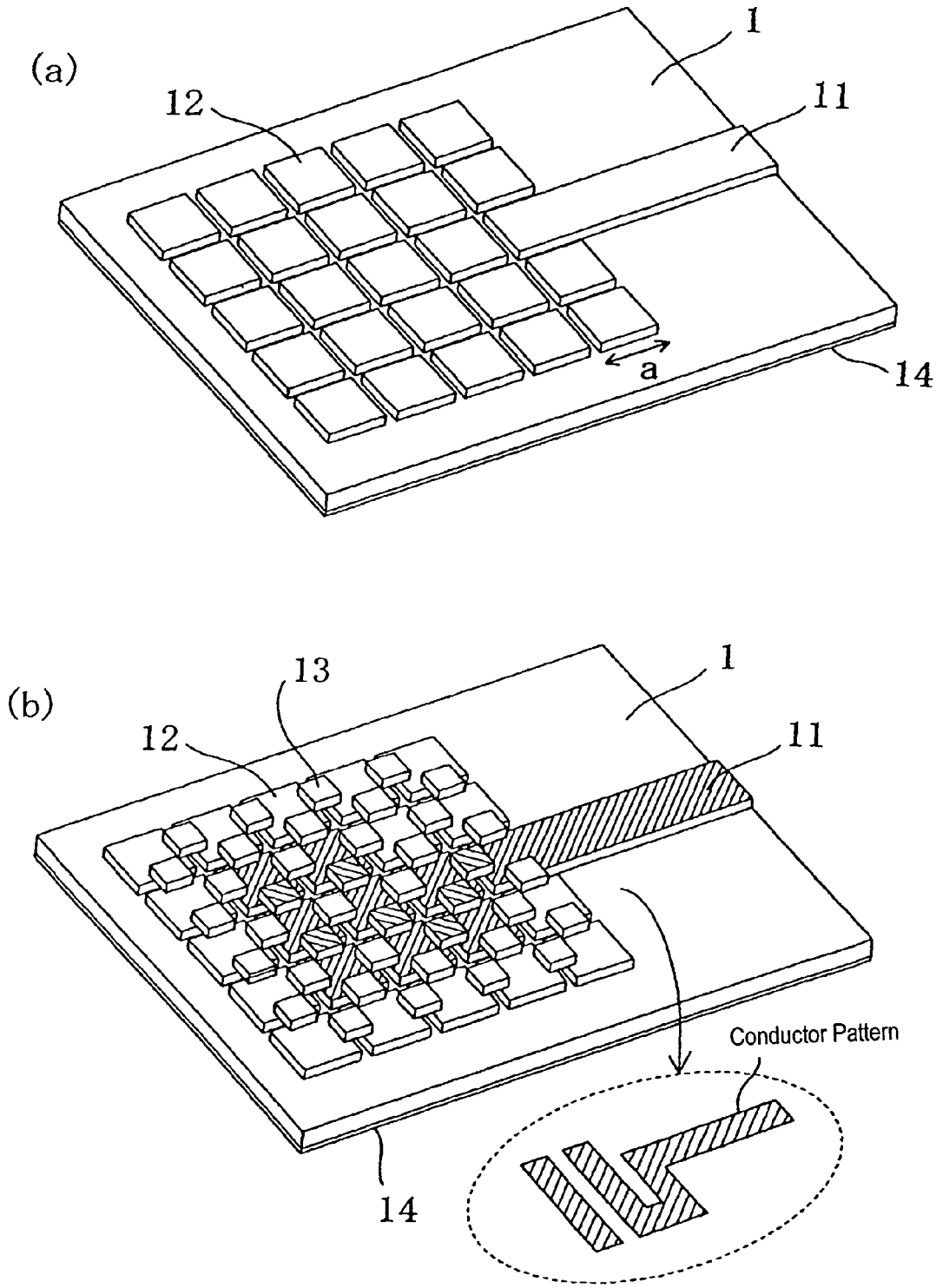
FIG. 3(*a*) is a perspective view showing an arrangement of conductor elements 12 in a first embodiment of a planer antenna according to the present invention, and FIG. 3(*b*) is a perspective view showing the antenna on which connecting elements 13 are disposed.

FIGS. 3(*a*) and 3(*b*) are perspective views of a planer antenna of current control type according to the first embodiment of the present invention before and after the assembling, respectively.

In this embodiment, as shown in FIG. 3(*a*), a dielectric substrate 1 in which a grounding conductor plate 14 is disposed on a back face thereof is first prepared. On the substrate 1, a plurality of conductor elements 12 are arranged in a matrix of rows and columns. In this embodiment, a micro strip line 11 which approaches three conductor elements 12 is disposed on the dielectric substrate 1.

The plane shape of each of the conductor elements 12 in this embodiment is square and the size is the same. In the example shown in FIG. 3(*a*), twenty-four conductor elements 12 are arranged in a region having a substantially square outline. However, the arrangement pattern of the conductor elements is not limited to this. In addition, the shapes and the sizes of the respective conductor elements 12 are not necessarily set to be equal to each other on one dielectric substrate 1.

A length a of one side of each conductor element 12 is set to be smaller than a wavelength of electromagnetic waves to be handled. More specifically, in the case where electromagnetic waves of 100 GHz (a wavelength of about 3 mm) are handled, for example, the length a of the conductor element 12 is set to be about 1.5 mm, for example. On the other hand, a thickness of the conductor element 12 is determined to be a sufficient thickness for satisfying the electric power and the impedance matching property of the electromagnetic waves to be transmitted or received.

The conductor elements 12 in the condition shown in FIG. 3(*a*) are mutually separated, and any electric connection is not formed. If the dielectric substrate 1 in this stage is irradiated with electromagnetic waves, a current required for transmitting or receiving the electromagnetic waves is not generated in the array of the conductor elements 12 because each of the conductor elements 12 is smaller than the wavelength. Thus, the respective conductor elements 12 in the condition shown in FIG. 3(*a*) do not function as an antenna.

In order to constitute an antenna by using the conductor elements 12, coupling means for electro-magnetically coupling arbitrary conductor elements 12 is required. In the example shown in FIG. 3(*b*), a connecting element 13 is used as the coupling means.

The connecting element 13 is disposed on adjacent two conductor elements 12 so as to overlap the conductor elements 12 in the example shown in FIG. 3(*b*). The concrete configuration and the forming method of the connecting element 13 will be described later in detail.

When electromagnetic waves are to be transmitted or received, some of the plurality of connecting elements 13 electrically interconnect the corresponding adjacent conductor elements 12, and the other connecting elements 13 do not electrically interconnect the corresponding adjacent conductor elements 12. For example, the connecting elements 13 which are hatched in FIG. 3(*b*) cause the adjacent conductor elements 12 to be conductive, but the other connecting elements 13 do not cause the adjacent conductor elements 12 to be conductive. Therefore, a conductor pattern shown in a lower right portion of FIG. 3(*b*) is formed on the substrate 1.

As described above, in the present invention, an array of the conductor elements 12 are first formed on the dielectric substrate 1, and then conductor elements 12 which are appropriately selected from the array of the conductor elements 12 are electrically interconnected, so as to form a conductor pattern which functions as at least part of an antenna.

Figure 4:
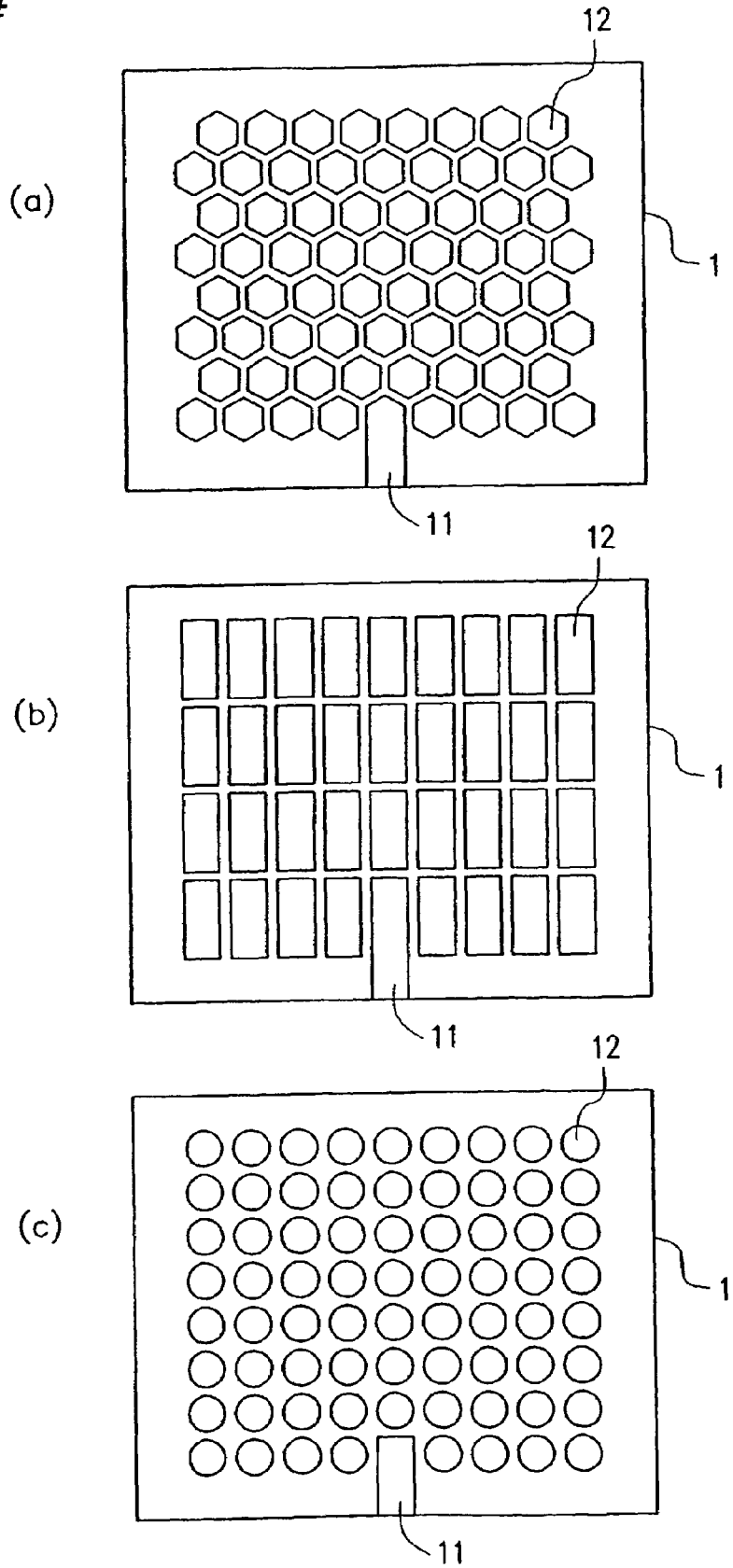
FIGS. 4(*a*) to 4(*c*) are plan views showing arrays of conductor elements 12 having various planer shapes in the first embodiment of the present invention, respectively.

In the example shown in FIG. 3(*a*), conductor elements 12 each having a substantially square plane shape are arranged in a matrix of rows and columns. In the antenna of the present invention, the plane shape of each conductor element 12 is not limited to be square. For example, as shown in FIG. 4(*a*), an array of conductor elements 12 each having a plane shape of regular hexagon may be used. Alternatively, an array of conductor elements 12 each having a rectangular shape shown in FIG. 4(*b*), or an array of conductor elements 12 each having a circular shape (or an elliptical shape) shown in FIG. 4(*c*) may be adopted. In addition, a conductor element having a triangle shape, or other polygonal shapes can be used.

After a metal film is formed on the dielectric substrate 1, the metal film is worked, so that a plane shape and a plane layout of conductor elements 12 can be arbitrarily set. The surface (the upper face) of each conductor element 12 shown in the figure is flat. Alternatively, unevenness may exist on the surface.

Figure 5:
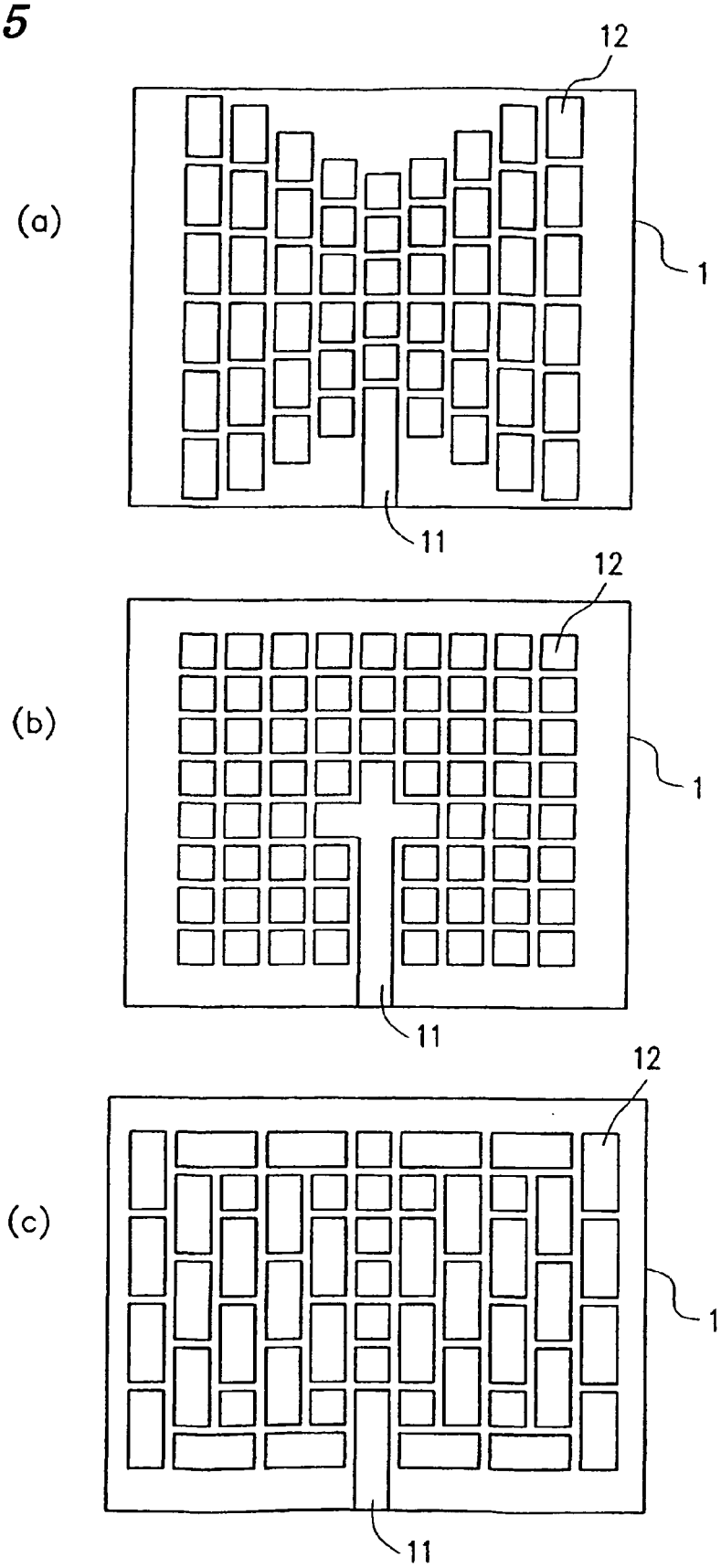
FIGS. 5(*a*) to 5(*c*) are plan views showing other exemplary arrangements of the array of conductor elements 12 in the first embodiment of the present invention.

All of the conductor elements 12 which constitute an antenna do not necessarily have the same size. As shown in FIG. 5(*a*), sizes and shapes of conductor elements 12 may vary depending on the positions thereof on the dielectric substrate 1.

FIG. 5(*b*) shows an improved example of the shape of a conductor member functioning as an input/output port. As shown in the figure, a conductor strip having a size of about wavelength of electromagnetic waves or more may exist in the inside of the array of the conductor elements 12.

FIG. 5(*c*) shows an example in which conductor elements 12 having different sizes and plane shapes mixedly exist in one array of conductor elements. Also in this case, the sizes (the length of a longer side in the case of a rectangle) of the respective conductor elements 12 are set to be smaller than the wavelength of radio waves to be transmitted and received.

Figure 6:
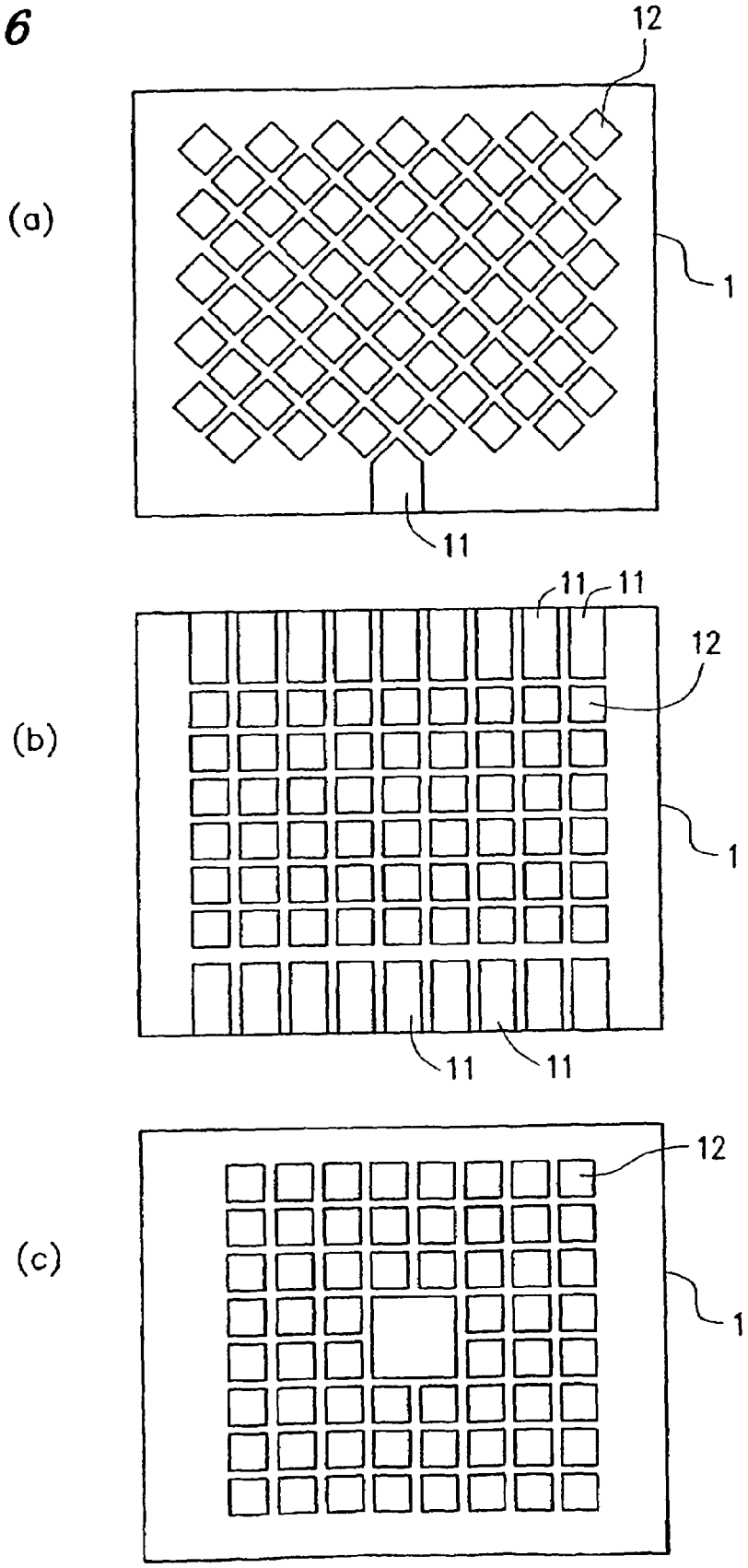
FIGS. 6(*a*) to 6(*c*) are plan views showing still other exemplary arrangements of the array of conductor elements 12 in the first embodiment of the present invention.

FIG. 6(*a*) shows an exemplary arrangement in which the arranged direction of conductor elements 12 is inclined by 45 degrees with respect to the arranged direction of the conductor elements 12 in the other examples.

FIG. 6(*b*) shows an example in which a plurality of conductor strips 11 capable of functioning as an input/output port are disposed. In this case, depending on the position of a circuit to be connected to the antenna, a conductor strip 11 in an appropriate position is selected as the input/output port.

FIG. 6(*c*) shows an example in which a conductor member functioning as an input/output port is positioned in a center portion instead of the peripheral portion of the dielectric substrate 1. In this example, the conductor member functioning as the input/output port is connected to an external circuit via a VIA disposed in the dielectric substrate.

In the antenna of the present invention, the arrangement pattern of the conductor elements 12 is arbitrary, and is not limited to the above-described kinds of exemplary arrangements. Alternatively, a ground electrode of a coplanar type line may be formed by a plurality of conductor elements 12.

Hereinafter examples of means for selecting arbitrary conductor elements 12 from an array of a plurality of conductor elements 12 arranged as described above, and for mutually connecting them will be described.

First Concrete Example

Figure 7:
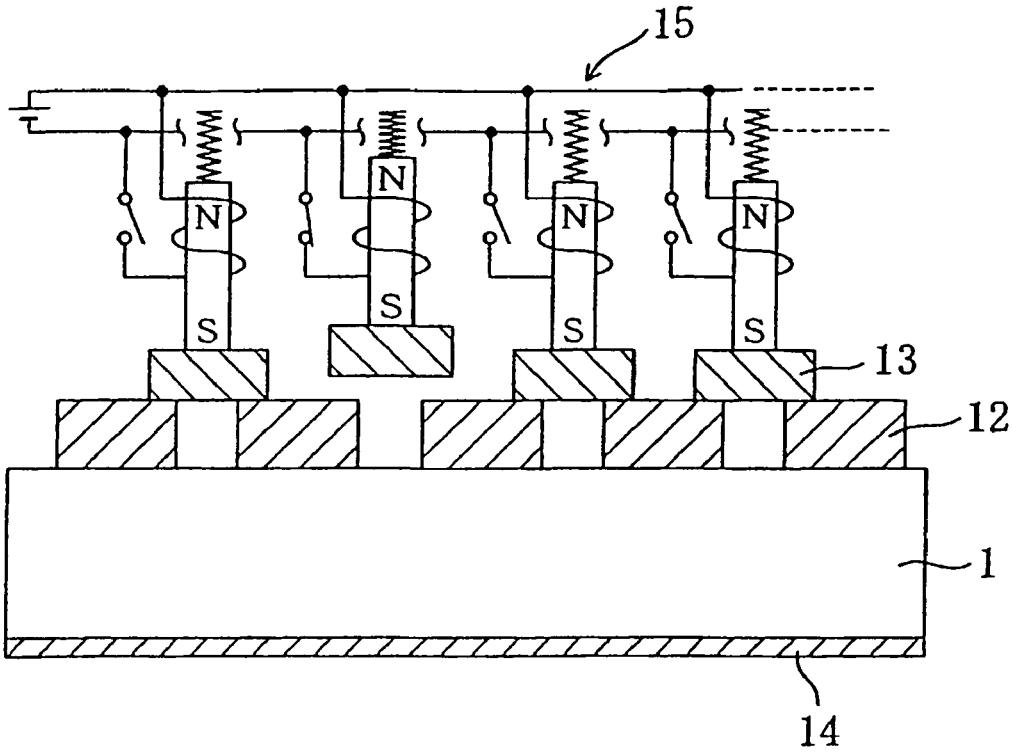
FIG. 7 is a sectional view showing a first example of connecting elements in the first embodiment.

First, FIG. 7 is referred to. In the example shown in FIG. 7, the position of the connecting element 13 is changed by an actuator. Specifically, the connecting element 13 is driven in a normal direction of a main face of the substrate 1 by a control system 15 provided with an actuator such as a solenoid coil, a switch, and a power supply. The connecting element 13 can reciprocate between a first position in which the connecting element 13 is in contact with adjacent two conductor elements 12 and a second position in which the connecting element 13 is not in contact with them. The connecting element 13 in the first position electrically connects the corresponding two conductor elements 12, but the connecting element 13 in the second position electrically separates the corresponding two conductor elements 12. For the array of the plurality of conductor elements 12, a plurality of connecting elements 13 are selectively moved by the control system 15, so that the form of the antenna element can be dynamically reconstructed.

As the actuator for moving the connecting element 13, other than the actuator utilizing the solenoid coil, an actuator utilizing piezoelectricity, an actuator by static electricity, and an actuator by shape memory alloy can be used. Such actuators can be suitably fabricated by using micro work techniques for producing a micro machine. The above-described actuator functions as a switching element for switching the electrically conductive/non-conductive conditions between at least two conductor elements.

Instead of the change of a pattern (form or plane layout) of the antenna element by using the control system 15 by a user or a manufacturer of an apparatus provided with the antenna (a portable terminal, for example), an inner circuit of the apparatus provided with the antenna can dynamically and automatically change the form of the antenna element depending on the conditions.

Second Concrete Example

Figure 8:
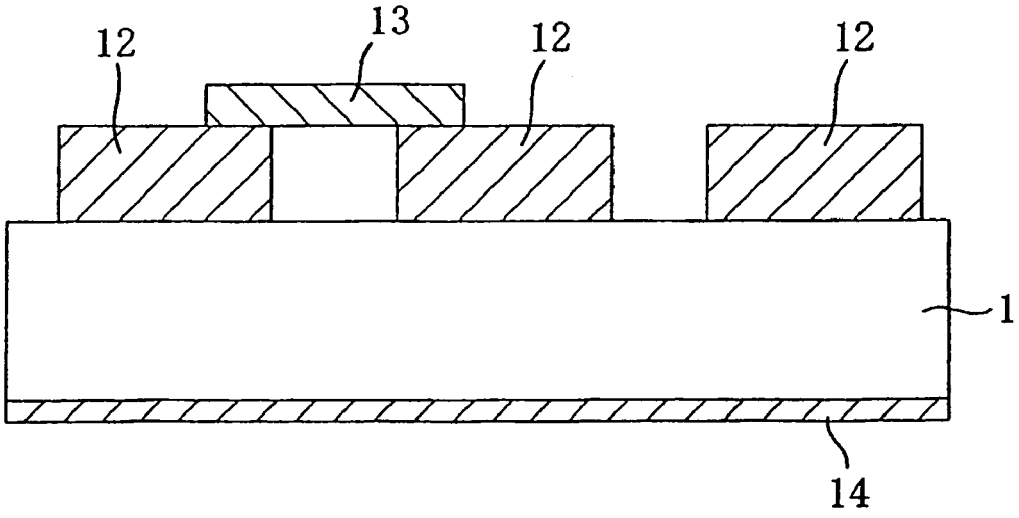
FIG. 8 is a sectional view showing a second example of connecting elements in the first embodiment.

Next, FIG. 8 is referred to. In the example shown in FIG. 8, a conductor piece functioning as a connecting element 13 for electrically connecting conductor elements 12 is disposed only in a selected position in an array of the conductor elements 12. For conductor elements 12 to be electrically separated, any conductor piece is not disposed in a position overlapping them. As such a conductor piece, a short strip formed of a metal such as aluminum can be used. The contact between the conductor piece and the conductor elements 12 may be realized by using a conductive adhesive, for example.

In this example, the position of the connecting element 13 is not changeable. Thus, the connection pattern of the conductor elements 12 is not dynamically changed. Accordingly, in this example, it may be difficult for a user to change the form of the antenna. However, according to the example shown in FIG. 8, a manufacturer of an apparatus provided with the antenna can optimize the form of the antenna element in a condition where the inner circuit of the apparatus is electrically connected to the antenna in a production stage of the apparatus. The characteristics of the antenna also vary depending on the characteristics of a circuit to be connected. Therefore, it is difficult to evaluate the characteristics of the antenna, and to determine the optimum form independently in view of the antenna. If a conventional antenna is incorporated in an apparatus and connected to a circuit, the characteristics of the antenna can be evaluated, but it is difficult to change the form of the antenna. On the other hand, in the example shown in FIG. 8, the connecting element 13 can be relatively easily detached.

In FIGS. 7 and 8, one connecting element 13 overlaps two conductor elements 12. Alternatively, the connecting element 13 may overlap three or more conductor elements 12.

Third Concrete Example

Figure 9:
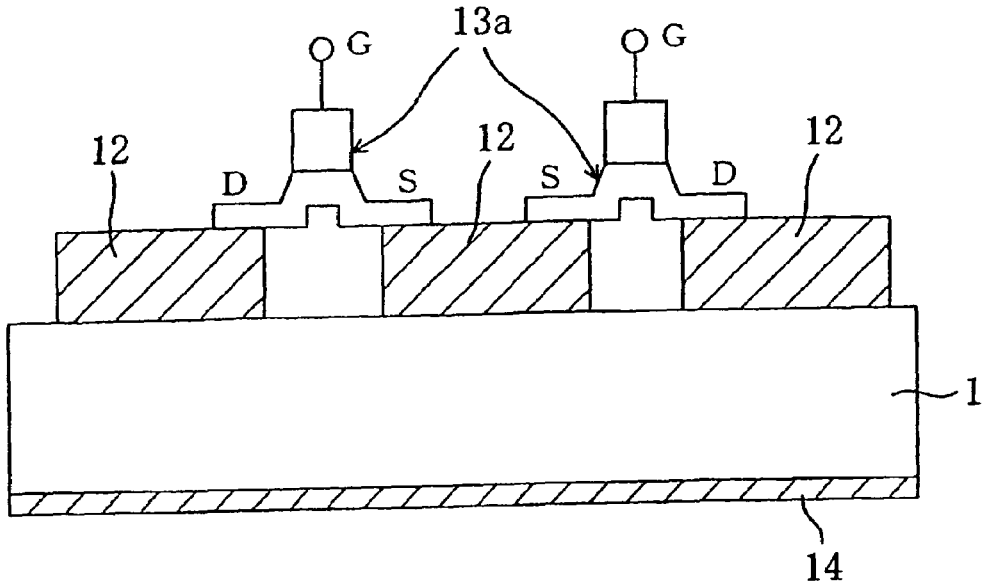
FIG. 9 is a sectional view showing a third example of connecting elements in the first embodiment.

Next, FIG. 9 is referred to. In the example shown in FIG. 9, a switching transistor 13*a* is formed between two adjacent conductor elements 12. The switching transistor 13*a* is selectively turned on or off, so that electric connection/non-connection conditions between the corresponding two conductor elements 12 can be controlled.

In FIG. 9, each switching transistor 13*a* includes a source S, a drain D, and a gate G. By adjusting an electrical potential at the gate G, the electric conductive/non-conductive conditions between the source S and the drain D can be switched. Each switching transistor 13*a* is formed from a thin film transistor, for example. The switching transistors 13*a* are arranged on a substrate 1 in a matrix. In order to selectively operate such switching transistors 13*a*, a driving circuit which is not shown is used. The driving circuit controls the operation of the plurality of switching transistors 13*a*, so as to select necessary conductor elements 12 and to mutually and electrically connect them, thereby forming a desired form of the antenna element.

In FIG. 9, for the sake of clarity, a transistor 13*a* is disposed on an upper side (on the side of a transmitting and receiving face for electromagnetic waves) of the conductor elements 12. In actuality, it is preferred that the transistor 13*a* be formed on a lower side of the conductor elements 12. This is because the wiring for mutually connecting the transistors 13*a* does not badly affect the transmission and reception of electromagnetic waves.

Instead of a voltage signal, the switching device such as the transistor 13*a* may be controlled by an optical signal. In such a case, a switching device in which the electric conductive/non-conductive condition is switched by irradiation of light is used. In an array of such switching devices, switching devices which are appropriately selected are irradiated with light, so that the connection pattern of conductive elements 12 can be freely set.

(Second Embodiment)

With reference to FIG. 10, a second embodiment of the planer antenna according to the present invention will be described.

The antenna shown in FIG. 10 is different from the antenna shown in FIG. 8 in that a dielectric film 17 formed from a plastic film or the like is disposed on conductor elements 12. Among a plurality of connecting elements 13, the selected connecting elements 13 are disposed closer to the conductor elements 12 via the dielectric film 17. However, the connecting elements 13 which are not selected are relatively distant from the conductor elements 12.

With reference to FIG. 11, the operation of the antenna shown in FIG. 10 is described. The connecting elements 13 are not directly in contact with the corresponding conductor elements 12 due to the existence of the dielectric film 17, but an electric capacity between the corresponding conductor elements 12 and the connecting element 13 is relatively high. Therefore, a displacement current is caused to flow between them in an electromagnetic field of high frequencies. Due to the displacement current, a condition where a current can flow between adjacent conductor elements 12 via the connecting element 13 is realized. In the case where the connecting elements 13 are relatively distant from the dielectric film 17, an electric capacity between the conductor elements 12 and the connecting element 13 is reduced, so that the displacement current is also reduced. Therefore, the connecting element 13 in such a position does not electrically connect the corresponding two connecting elements 13, substantially.

As described above, even if the dielectric film 17 is interposed between the conductor elements 12 and the connecting element 13, the separated conductor elements 12 can be electrically connected by the displacement current flowing via the connecting element 13.

In FIG. 11, a connecting element 13 which is not used for electrically connecting the conductor elements 12 is shown above the dielectric film 12. Another dielectric film may be formed between the connecting element 13 and the dielectric film 12 which are distant from each other. In such a case, the distance between the connecting element 13 and the conductor elements 12 cannot be varied. Instead of such a configuration, the connecting element 13 may be driven by an actuator such as shown in FIG. 7, for example. With such a configuration, the combination of conductor elements 12 between which a displacement current flows can be dynamically changed by changing the position of the connecting element 13, as required.

As shown in FIG. 8, a connecting element 13 is selectively disposed in a portion of the dielectric film 17 under which the conductor elements 12 are to be conductive, thereby electrically connecting the selected conductor elements 12. In such a case, in a production process of an apparatus provided with an antenna, an antenna element having an optimum form can be easily manufactured.

In addition, a switching transistor 13*a* shown in FIG. 9 can be used as the connecting element 13. By turning on or off the switching transistor 13*a*, a condition where the conductor elements 12 are conductive and a condition where the conductor elements 12 are not conductive can be dynamically switched.

(Third Embodiment)

Figure 12:
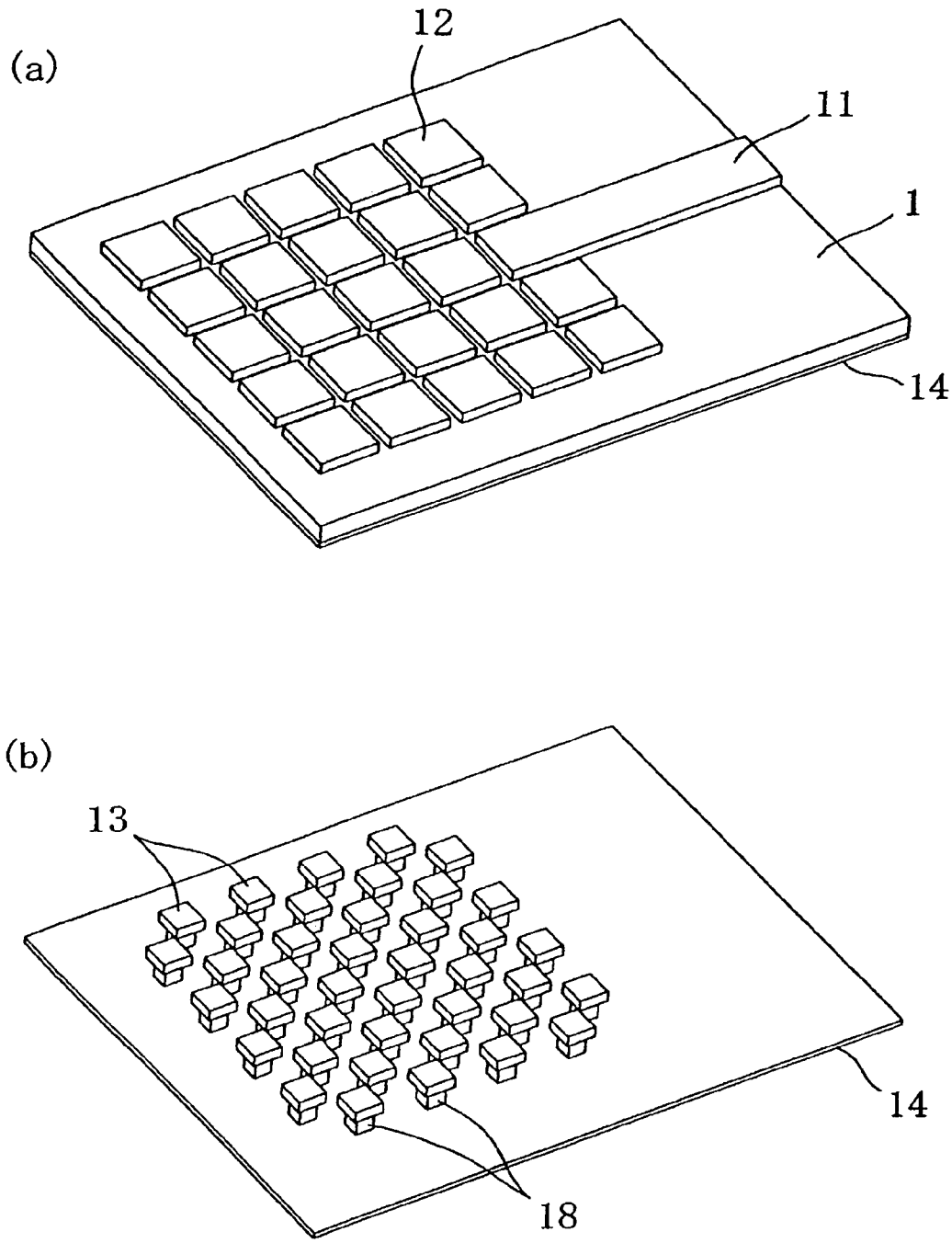
FIG. 12(*a*) is a perspective view showing an appearance configuration of a third embodiment of the antenna according to the present invention, and FIG. 12(*b*) is a perspective view showing the antenna in a condition where a dielectric substrate and conductor elements are removed.

FIG. 12(*a*) is a perspective view showing an appearance structure of a planer antenna of current control type of the third embodiment according to the present invention. FIG. 12(*b*) is a perspective view showing a structure in which a dielectric substrate and conductor elements are removed from the antenna of this embodiment.

Also in this embodiment, as shown in FIG. 12(*a*), on a dielectric substrate 1 in which a grounding conductor plate 14 is disposed on a back face thereof, conductor elements 12 each having a square plane shape are arranged in an array. A length a of one side of each conductor element 12 is smaller than a wavelength of electromagnetic waves to be handled. For example, in the case where a signal of about 100 GHz (a wavelength of about 3 mm) is handled, the length a of the conductor element 12 is about 1.5 mm. The thickness of the conductor element 12 is determined to be a thickness sufficient for satisfying the power and the impedance matching property of the electromagnetic waves to be transmitted and received. On the dielectric substrate 1, a micro strip line 11 is disposed so as to approach three conductor elements 12.

As shown in FIG. 12(*b*), under the array of the conductor elements 12, a connecting element 13 which overlaps adjacent two conductor elements 12 is disposed. The connecting element 13 does not appear in FIG. 12(*a*) because the connecting element 13 is covered with the conductor elements 12 and the dielectric substrate 1, but the connecting element 13 is disposed in a recessed portion formed in the dielectric substrate 1. Under the connecting element 13, an actuator 18 for vertically driving the connecting element 13 is attached. There are several kinds of actuators 18, and the specific configurations thereof will be described below. In order to control (or adjust) the current so as to have a desired magnitude and pattern, similarly to the first embodiment, some of the connecting elements 13 make the corresponding conductor elements 12 on both sides thereof to be conductive, and the other connecting elements 13 make the corresponding conductor elements 12 on both sides thereof to be non-conductive.

Also in this embodiment, as in the second embodiment, a dielectric film may be interposed between the connecting elements 13 (or 13') and the conductor elements 12 (or 12').

Next, examples of means for controlling the conductive/non-conductive conditions of the conductor elements 12 by the connecting element 13 will be described. Also in this embodiment, the non-conductive condition includes a condition where a weak current which cannot be utilized as a signal flows.

First Concrete Example

FIGS. 13(*a*) and 13(*b*) are sectional views showing the configuration of an actuator in the first example of the third embodiment. As shown in the figures, in this example, the actuator is constituted by a solenoid coil, a spring, and the like. The actuator is constituted in such a manner that, by the control of a circuit in which a switch and a power supply are disposed, a condition where the connecting element 13 is in contact with the conductor elements 12 (see FIG. 13(*b*)) and a condition of non-contact (see FIG. 13(*a*)) are switched. In the case of this example, a user can directly adjust the pattern of an antenna element, or an inner circuit can automatically control the pattern of the antenna element to be an appropriate pattern.

Second Concrete Example

Figure 14:
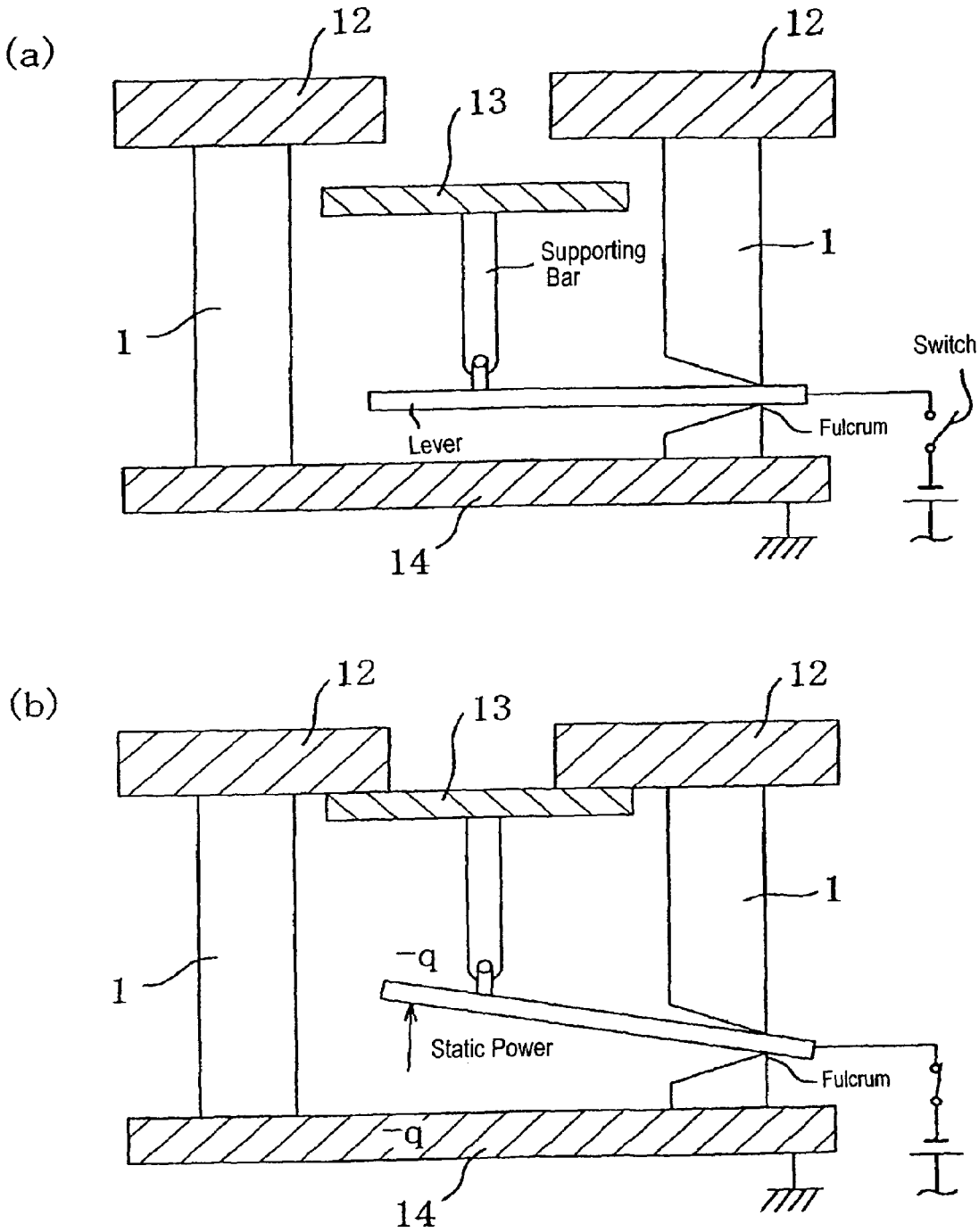
FIGS. 14(*a*) and 14(*b*) are sectional views showing a second example of conducting means in the third embodiment of the antenna according to the present invention, respectively.
Figure 1:
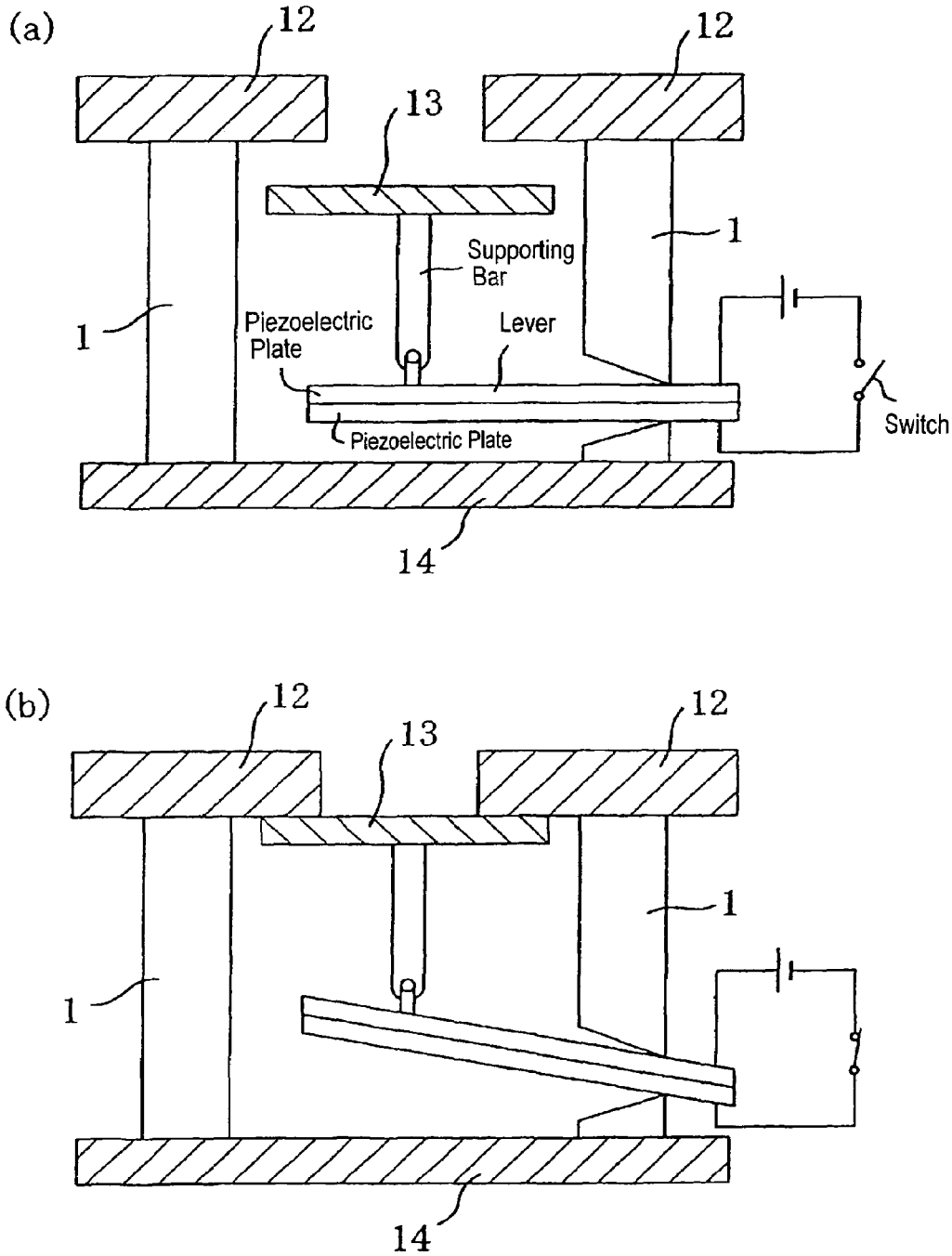

FIGS. 14(*a*) and 14(*b*) are sectional views showing the configuration of an actuator in a second example of the third embodiment. As shown in the figures, in this example, the actuator is constituted by a lever which can be rotated with respect to a fulcrum, and a supporting bar, disposed rotatably by the lever, for supporting a connecting element 13, and the like. The actuator is constituted in such a manner that, by the control of a circuit including a switch, a power supply, and the like, a condition where the connecting element 13 is in contact with the conductor elements 12 (see FIG. 14(*b*)), and a condition of non-contact (see FIG. 14(*a*)) are switched. In the case of this example, a user can directly adjust the pattern of an antenna element, or an inner circuit can automatically control the pattern of the antenna element to be an appropriate pattern.

Third Concrete Example

FIGS. 15(*a*) and 15(*b*) are sectional views showing the configuration of an actuator in a third example of the third embodiment. As shown in the figures, in this specific example, the actuator is constituted by a lever which can rotate with respect to a fulcrum, a supporting bar, disposed rotatably by the lever, for supporting the connecting element 13, and the like. The lever is formed by horizontally bonding two plates having different piezoelectric coefficients together. In this case, the materials are selected so that the plate on the lower side is more extended than the plate on the upper side when a potential flows. Therefore, when electricity flows through the two plates, the lever is warped to the upper side. The lever is constituted in such a manner that, by the control of a circuit provided with a switch, a power supply, and the like, a condition where the connecting element 13 is in contact with the conductor elements 12 (see FIG. 15(*b*)) and a condition of non-contact (see FIG. 15(*a*)) are switched. In the case of this example, a user can directly adjust the pattern of an antenna element, or an inner circuit can dynamically and automatically control the pattern of the antenna element to be an appropriate form.

(Fourth Embodiment)

Figure 16:
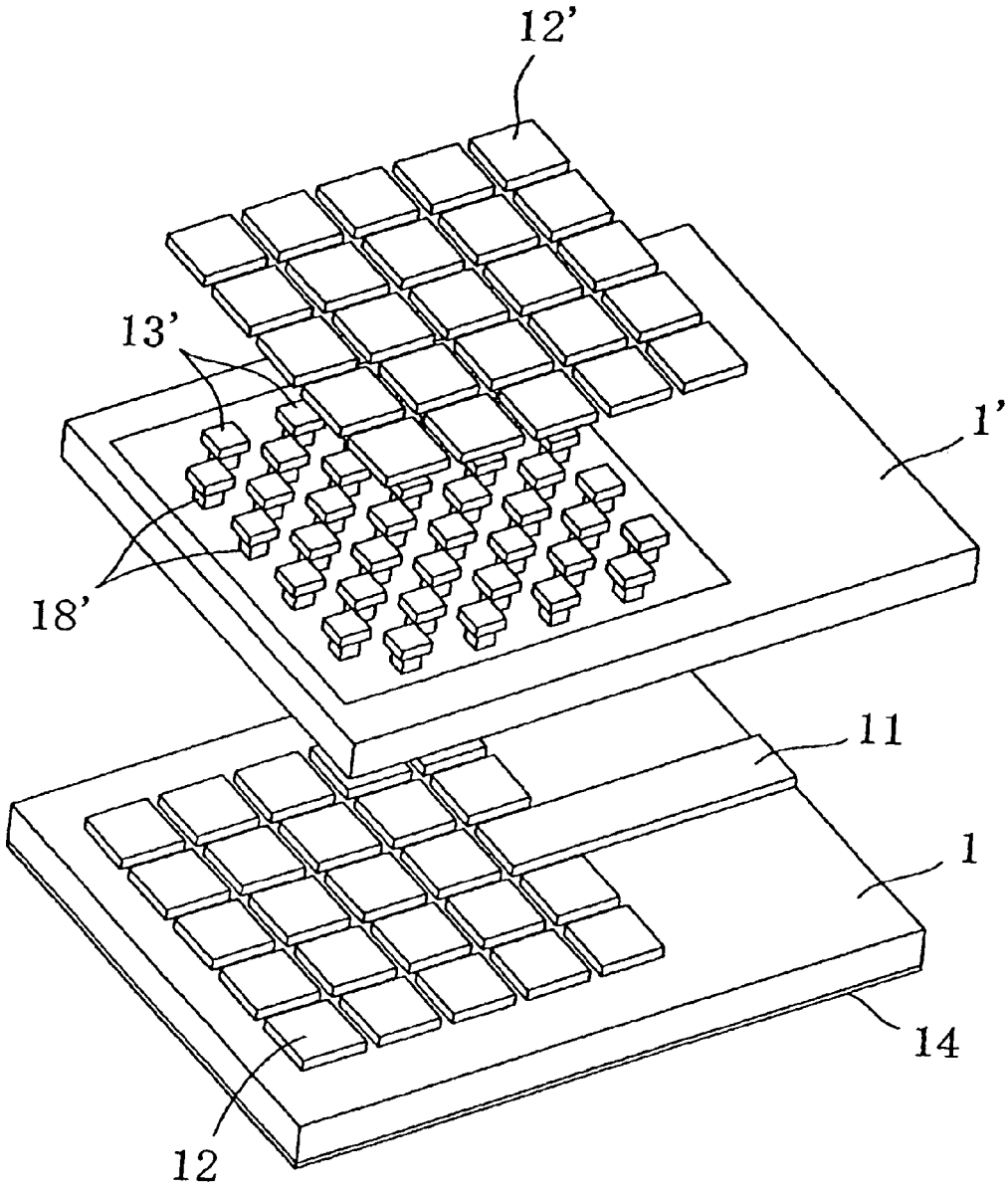
FIG. 16 is a perspective view showing an appearance configuration of a fourth embodiment of the antenna according to the present invention.

FIG. 16 is a perspective view showing a fourth embodiment of an antenna according to the present invention.

In this embodiment, as shown in FIG. 16 on a dielectric substrate 1 in which a grounding conductor plate 14 is disposed on a back face thereof, conductor elements 12 each having a square plane shape are arranged in an array. In addition, on the conductor elements 12, a dielectric substrate 1' and connecting elements 13' and actuators 18' are disposed. In addition, conductor elements 12' which overlap the respective connecting elements 13' are laminated above the connecting elements 13'. As the actuators 18', actuators which are described above in the third embodiment can be utilized. Instead of the actuators 18', a mechanism for switching the conductive/non-conductive conditions described in the first embodiment can be disposed.

Also, as described in the second embodiment, a dielectric film may be interposed between the connecting elements 13 (or 13') and the conductor elements 12 (or 12').

In this embodiment, a plurality of layers in which a plurality of conductor elements 12 and 12' are arranged are laminated, and the electrical conductive condition between the conductor elements 12 and 12' in the respective layers can be controlled by the actuators 18' or the like in the laminated direction. Therefore, by the antenna of this embodiment, a three-dimensional current distribution can be realized.

In the first to fourth embodiments, examples in which the conductor elements 12, the connecting elements 13, the actuators, and the like are regularly arranged are described. The arranged way, and the shape of the conductor 2 can be varied depending on the respectively desired antenna characteristics so as to realize the characteristics.

(Fifth Embodiment)

Figure 17:
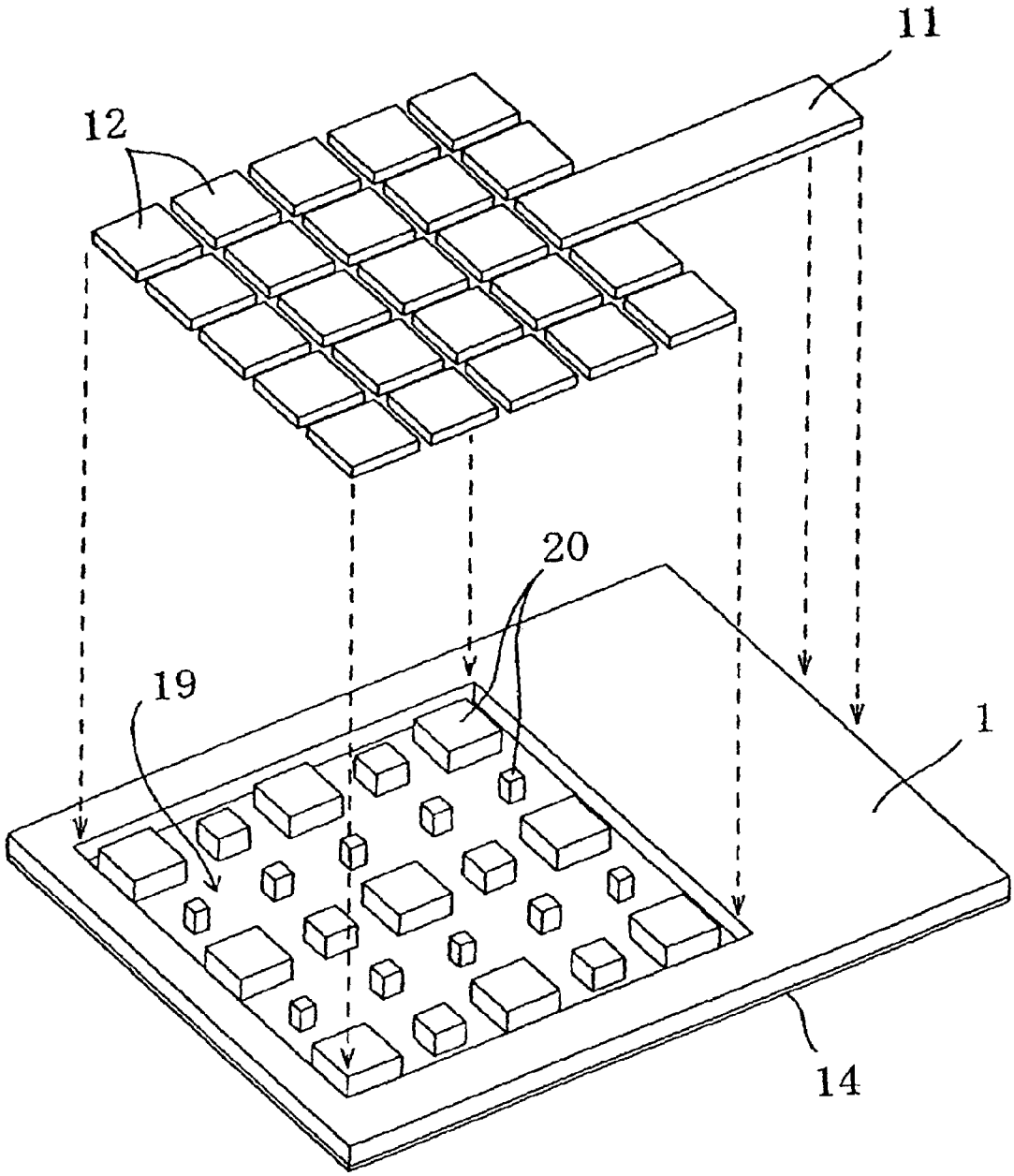
FIG. 17 is a perspective view showing a configuration of a fifth embodiment of the antenna according to the present invention.
Figure 18:
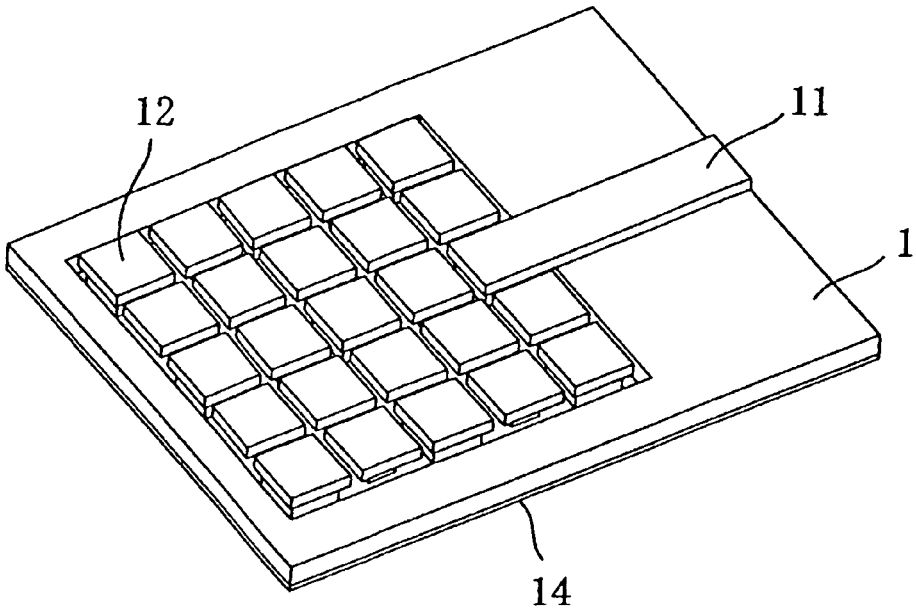
FIG. 18 is a perspective view showing an appearance configuration of the fifth embodiment of the antenna according to the present invention.

FIG. 17 is an exploded perspective view showing a fifth embodiment of a planer antenna according to the present invention. FIG. 18 is a perspective view showing a general appearance of the antenna. The antenna of the fifth embodiment is of a magnetic current control type.

For the purpose of easily understanding the structure, FIG. 17 shows a condition where conductor elements 12 and strip lines 11 are removed from a dielectric substrate 1. FIG. 18 shows the structure in which the conductor elements 12 and the strip lines 11 are disposed on the dielectric substrate 1.

In this embodiment, as shown in FIG. 18, on the dielectric substrate 1 in which a grounding conductor plate 14 is disposed on a back face thereof, conductor elements 12 each having a square plane shape are arranged in an array. On the dielectric substrate 1, a micro strip line 11 is disposed so as to approach three conductor elements 12. A length a of one side of each of the conductor elements 12 is smaller than the wavelength of the electromagnetic waves to be handled. In the case where a signal of about 100 GHz is handled, for example, the length a of a conductor element 12 is about 1.5 mm. The thickness of a conductor element 12 is determined to be sufficient for satisfying the electric power and the impedance matching property of the electromagnetic waves to be transmitted and received.

Under the conductor elements 12, as shown in FIG. 17, dielectric elements 20 interposed between the respective conductor elements 12 and the grounding conductor plate 14 are disposed. The dielectric elements 20 are formed by patterning from the dielectric substrate 1 together with a recessed portion 19. FIG. 17 shows three kinds of dielectric elements 20 having different plane areas. In this embodiment, as shown in FIGS. 19(*a*) and 19(*b*), for the case where a first dielectric element 20*a* having the same plane area as that of the conductor element 12 and a first dielectric element 20*b* having a smaller plane area than that of the conductor element 12, a magnetic current to be generated is described.

Figure 19:
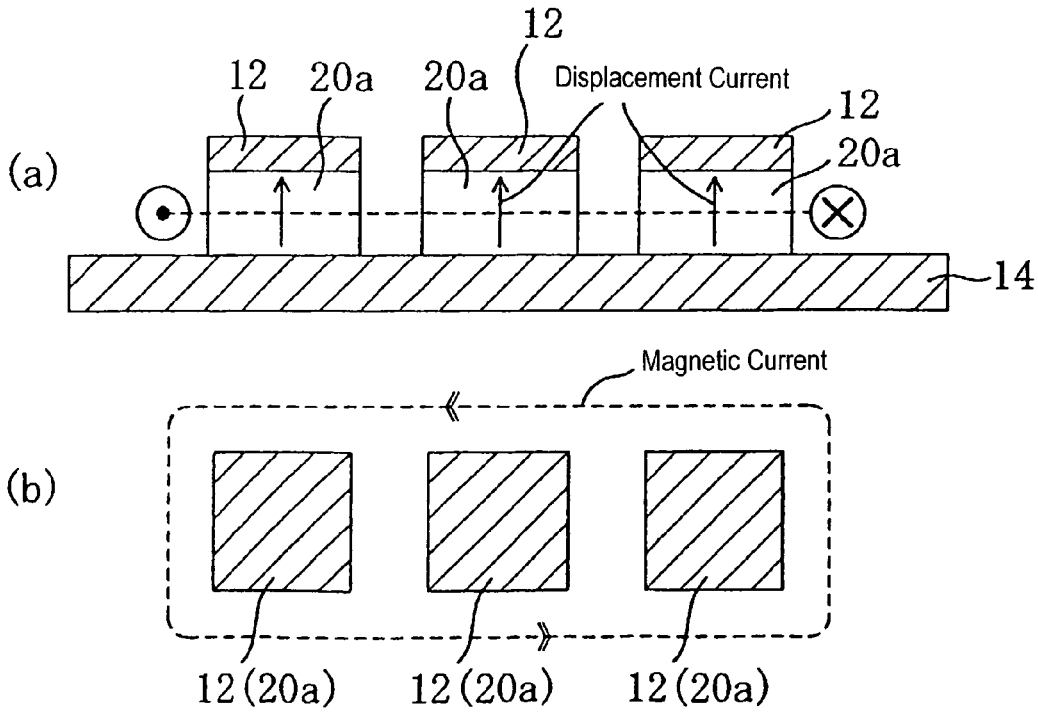
FIG. 19(*a*) is a sectional view of a planer antenna in which three first dielectric elements exist under three conductor elements, and FIG. 19(*b*) is a plan view thereof.

FIGS. 19(*a*) and 19(*b*) are a sectional view and a plan view of a planer antenna in which three first dielectric elements 20*a* exist under three conductor elements 12. As shown in FIG. 19(*a*), between the respective conductor element 12 and the grounding conductor film 14, the first dielectric element 20*a* having a larger area is interposed, so that a large displacement current is caused to flow between the respective conductor element 12 and the grounding conductor film 14 because of a large electric capacity. As a result, as shown in FIG. 19(*b*), a magnetic current surrounding the three conductor elements 12 is formed.

FIGS. 20(*a*) and 20(*b*) are a sectional view and a plan view of an antenna in which first dielectric elements 20*a* having a larger area exist under two conductor elements 12 on both ends of three conductor elements 12, and a second dielectric element 20*b* having a smaller area exists under the center conductor element 12. Generally, in the case where only an insulator having an extremely small specific inductive capacity exists between two conductors, only a small displacement current is caused to flow between the two conductors because of the reduction in electric capacity. That is, a magnetic current is hardly generated around the center conductor element 12, so that the magnetic currents caused around the conductor elements 12 on both ends are not coupled. As a result, as shown in FIG. 20(*b*), isolated magnetic currents surrounding only the conductor elements 12 on both ends are formed.

As described above, the control (or adjustment) of the magnetic current patterns as shown in FIGS. 19(*b*) and 20(*b*) can be performed.

(Sixth Embodiment)

An antenna of this embodiment has substantially the same structure of the antenna shown in FIGS. 17 and 18. Instead of the capacitive insulating films 20*a* and 20*b* in the fifth embodiment, the antenna of this embodiment includes a first dielectric element 21*a* having a relatively high specific inductive capacity $\in 1$, and a second capacitive insulating film 21*b* having a relatively low specific inductive capacity $\in 2$.

FIGS. 21(*a*) and 21(*b*) are a sectional view and a plan view of a planer antenna in which three first dielectric elements 20*a* exist under three conductor elements 12. As shown in FIG. 21(*a*), a first dielectric element 21*a* having a higher specific inductive capacity $\in 1$ exists between the respective conductor element 12 and the grounding conductor film 14, so that a large displacement current is caused to flow between the respective conductor element 12 and the grounding conductor film 14 because of a large electric capacity. As a result, as shown in FIG. 21(*b*), a magnetic current surrounding the three conductor elements 12 is formed.

FIGS. 22(*a*) and 22(*b*) are a sectional view and a plan view of an antenna in which first dielectric elements 21*a* having a higher dielectric constant $\in 1$ exist under two conductor elements 12 on both ends of three conductor elements 12, and a second dielectric element 21*b* having a specific inductive capacity $\in 2$ lower than $\in 1$ exists under the center conductor element 12. Generally, in the case where only an insulator having an extremely small specific inductive capacity is interposed between two conductors, only a small displacement current is caused to flow between the two conductors because of the reduction in electric capacity. That is, a magnetic current is hardly caused around the center conductor element 12, so that the magnetic currents caused around the conductor elements 12 on both ends are not coupled. As a result, as shown in FIG. 22(*b*), isolated magnetic currents surrounding the respective conductor elements 12 on both ends are formed.

As described above, the control (or adjustment) of the magnetic current patterns as shown in FIGS. 21(*b*) and 22(*b*) can be performed.

(Seventh Embodiment)

The antenna of magnetic current control type of this embodiment has substantially the same structure as that shown in FIGS. 17 and 18. Instead of the respective dielectric elements 20*a* and 20*b* in the fifth embodiment, the antenna of this embodiment includes a first dielectric element 23*a* having a higher averaged specific inductive capacity and a second dielectric element 23*b* having a lower averaged specific inductive capacity. Each of the first dielectric element 23*a* and the second dielectric element 23*b* is constituted by a first insulator 22*a* having a higher specific inductive capacity ∈1 and a second insulator 22*b* having a lower specific inductive capacity ∈2. In the first dielectric element 23*a*, a ratio of the first insulator 22*a* is larger than that of the second insulator 22*b*. In the second dielectric element 23*b*, a ratio of the second insulator 22*b* is larger than that of the first insulator 22*a*.

FIGS. 23(*a*) and 23(*b*) are a sectional view and a plan view of a planer antenna in which three first dielectric elements 23*a* exist under three conductor elements 12. As shown in FIG. 23(*a*), the first dielectric elements 23*a* having a higher averaged specific inductive capacity exist between the respective conductor elements 12 and the grounding conductor film 14, so that a large displacement current is caused to flow between the respective conductor elements 12 and the grounding conductor film 14 because of a large electric capacity. As a result, as shown in FIG. 23(*b*), a magnetic current surrounding the three conductor elements 12 is formed.

FIGS. 24(*a*) and 24(*b*) are a sectional view and a plan view of an antenna in which first dielectric elements 23*a* having a higher averaged specific inductive capacity exist under two conductor elements 12 on both ends of three conductor elements 12, and a second dielectric element 23*b* having a lower averaged specific inductive capacity exists under the center conductor element 12. Generally, in the case where only an insulator having an extremely small specific inductive capacity is interposed between two conductors, only a small displacement current is caused to flow between the two conductors because of the reduction in electric capacity. That is, a magnetic current is hardly caused around the center conductor element 12, so that the magnetic currents caused around the conductor elements 12 on both ends are not coupled. As a result, as shown in FIG. 24(*b*), isolated magnetic currents surrounding only the respective conductor elements 12 on both ends are formed.

As described above, the control (or adjustment) of the magnetic current patterns as shown in FIGS. 23(*b*) and 24(*b*) can be performed.

(Eighth Embodiment)

An antenna of magnetic current control type of this embodiment has substantially the same structure as that of FIGS. 17 and 18. Instead of the dielectric elements 20*a* and 20*b* the fifth embodiment, the antenna includes dielectric elements 20 having the same area and specific inductive capacity.

FIGS. 25(*a*) and 25(*b*) are a sectional view and a plan view of a planer antenna in which three conductor elements 12 are in contact with the dielectric elements 20, respectively. As shown in FIG. 25(*a*), only the dielectric elements 20 are interposed between the respective conductor elements 12 and the grounding conductor film 14, so that a large displacement current is caused to flow between the respective conductor elements 12 and the grounding conductor film 14 because of the large electric capacity. As a result, as shown in FIG. 25(*a*), a magnetic current surrounding the three conductor elements 12 is formed.

FIGS. 26(*a*) and 26(*b*) are a sectional view and a plan view of an antenna in which two conductor elements 12 on both ends of three conductor elements 12 are in contact with the dielectric elements 20, but the center conductor element 12 is separated from the dielectric element 20. Generally, in the case where only an insulator having an extremely small specific inductive capacity such as an air is interposed between two conductors, only a small displacement current is caused to flow between the two conductors because of the reduction in electric capacity. That is, a magnetic current is hardly caused around the center conductor element 12, so that the magnetic currents caused around the conductor elements 12 on both ends are not coupled. As a result, as shown in FIG. 26(*b*), isolated magnetic currents only surrounding the respective conductor elements 12 on both ends are formed.

As described above, the control (or adjustment) of the magnetic current patterns as shown in FIGS. 25(*b*) and 26(*b*) can be performed.

The control (or adjustment) between the contact and the non-contact of the conductor element 12 with the dielectric element 20 can be easily realized by utilizing an actuator described in each examples in the third embodiment, for example.

[Another Embodiment Relating to the Structure of Antenna]

The antenna of the present invention can be applied to an aperture antenna such as a parabolic antenna and a reflective mirror antenna, a linear antenna such as a dipole antenna and a patch antenna, and a slot antenna, for example, in addition to the planer antenna.

FIG. 27 is a view schematically showing an exemplary structure of the case where the present invention is applied to a horn antenna. As shown in the figure, a large number of conductor elements 12 are disposed in an array on an inner face of the horn antenna. Similarly to the above-described first to fourth embodiments, the control (or adjustment) for switching the conductor elements 12 through which a current flows (a hatched portion in the figure) and the conductor elements 12 through which any current does not flow is performed. Thus, it is possible to realize a horn antenna of current control type which can address the change of various electromagnetic waves.

FIG. 28 is a view schematically showing an exemplary structure of the case where the present invention is applied to a slot antenna. As shown in the figure, a large number of conductor elements 12 are disposed in an array on an inner face of the slot antenna. Similarly to the above-described first to fourth embodiments, the control (or adjustment) for switching the conductor elements 12 through which a current flows (a hatched portion in the figure) and the conductor elements 12 through which any current does not flow is performed. Thus, it is possible to realize a slot antenna of current control type or magnetic current control type which can address the change of a wide variety of electromagnetic waves.

Alternatively, respective conductor portions of a linear antenna such as a Yagi antenna, or a number of conductor elements on a curved face of a parabolic antenna having the curved face are disposed in an array, and the flow of a current to the respective conductor elements is controlled, whereby it is possible to realize an antenna of current control type which can address the change of a wide variety of electromagnetic waves.

[Embodiments of Apparatus Provided with the Antenna]

Hereinafter, embodiments of apparatuses provided with antenna according to the present invention will be described. The following embodiments describe exemplary antennas including switching elements which can dynamically change the connection of conductor elements as conducting means.

(Ninth Embodiment)

FIG. 29 is a block circuit diagram showing an embodiment of an apparatus provided with an antenna of the present invention.

The apparatus of this embodiment includes, as shown in FIG. 29, the above-described antenna 50 of the present invention, a communication circuit 61 connected to the antenna 50, and a controller for controlling the form of the antenna 50.

The apparatus further includes a driver 51 for driving conducting means (not shown) included in the antenna 50, a designing section 53 for determining the form of the antenna, a form design controller (topology search controller) 54 for controlling the driver 51, and a memory 55 for storing information on the antenna. The information on the antenna stored in the memory 55 includes physical sizes (area, thickness, and the like) of a conductor element, a dielectric element, a connecting element, a dielectric substrate, and the like, and initial conditions of the form of the antenna 50.

The apparatus further includes a level detector 71 for detecting a level of a signal transmitted and received by the antenna 50, a directivity check section 72 for checking the directivity of the antenna 50 based on the level of the signal detected by the level detector 71, a gain check section 73 for checking the gain from the detected level of the signal, and an impedance check section 74 for checking the impedance matching property of the antenna 50 and the communication circuit 61 from the detected level of the signal. The term "check" in this specification may include an operation for measuring physical quantities relating to the directivity, the gain, and the impedance.

Next, the operation of the apparatus will be described.

First, the form designing section 53 determines the initial form of the antenna 50 based on the information stored in the memory 55. Based on the designed result by the form designing section 53, the form design controller 54 controls the driver 51 so that the antenna 50 has the same form as the designed form. The driver 51 drives the conducting means so that the respective elements of the antenna 50 form the desired antenna form.

Since the antenna 50 can be used for transmission and reception, it is desired that the optimization of the form of the antenna 50 be independently performed for the antenna for transmission and for the antenna for reception.

Hereinafter the procedure for adjusting the form in the case where the antenna 50 is used as an antenna for transmission is described.

First, the communication circuit 61 transmits a signal for transmission to the antenna 50. The signal is also input into the level detector 71. In this embodiment, on a signal path between the communication circuit 61 and the antenna 50, a member for directional coupling for a high frequency signal is disposed. Therefore, it is possible to perform the adjustment in such a manner that, if a signal is sent from the communication circuit 61 to the antenna 50, the signal reflected from the antenna 50 to the communication circuit 61 is not returned. The level detector 71 can detect both of the level of the signal transmitted from the communication circuit 61 to the antenna 50 and the level of the signal reflected from the antenna 50.

The directivity check section 72 determines whether the directivity of the antenna 50 in transmission is in an allowable range or not, based on the level of the high frequency signal detected by the level detector 71. Specifically, in the case where the level of the signal reflected from the antenna 50 is varied depending on the direction of the antenna 50, if the difference in level of the reflected signals in the respective directions is in a certain range, it is determined that the directivity is in the allowable range. If the difference is not in the certain range, it is determined that the directivity is not in the allowable range. In this way, the directivity in the transmission of the antenna 50 is checked. There exist a case where it is desired that the directivity be as low as possible and a case where it is desired that the directivity be as high as possible. Therefore, the range used for checking the directivity may vary depending on the kind and application of the equipment to which the antenna is applied, and the purpose of reception or transmission.

The gain check section 73 checks the gain of the antenna 50 based on a condition whether the ratio of the level of the transmitted signal from the communication circuit 61 and to the level of the signal reflected from the antenna 50 is in the allowable range, or not, and other conditions. Generally, it is desired that the ratio of the level of the transmitted signal to the level of the reflected signal be as high as possible. Thus, if the ratio is a certain value or more, it is determined that the gain is good.

The impedance check section 74 checks the impedance matching between the communication circuit 61 and the antenna 50, based on a condition whether the ratio of the level of the signal output from the communication circuit 61 to the level of the signal reflected from the antenna 50 is in an allowable range, or not, and other conditions. Generally, a high ratio of the level of the reflected signal to the level of the input signal to the antenna 50 means that the impedance matching is not realized. Therefore, if the ratio in level is a certain value or more, it is determined that the impedance matching property is good.

Preferably, until it is determined that all of the directivity, the gain, and the impedance matching property are good, the designing of the form of the antenna is repeatedly performed in the form designing section 53, and the form of the antenna 50 is dynamically reconstructed via the form design controller 54 and the driver 51. When it is eventually determined that all of the directivity, the gain, and the input impedance matching property are good, information (data) relating to the form is stored in the memory 55.

There may be a case where it is sufficient that all of the directivity, the gain, and the impedance matching property are not determined to be good. Alternatively, there may be a case where the form of the antenna 50 is optimized in a mode in which the directivity is emphasized, and the gain is neglected.

FIG. 30 shows an example of relationships between the antenna form, and the directivity and the like. In FIG. 30, the symbol "◎" indicates that it is excellent, and the symbol "○" indicates that it is superior. The symbol "Δ" indicates that it is common. For example, the antenna having an antenna element which straightly extends as a line in FIG. 30 is superior in impedance, but is common in the directivity and the gain.

In this embodiment, based on the data stored in the memory 55, the conducting means of the antenna 50 is driven so that the coupling pattern of the conductor elements in the antenna 50 sequentially takes a plurality of kinds of forms which are previously set. For example, a plurality of forms including the three forms shown in FIG. 30 are sequentially realized in the antenna 50. In the respective forms, the directivity, the gain, and the impedance matching property are evaluated, and the evaluated results are stored in the memory. In FIG. 30, the evaluated results are shown by using the symbols such as "○" and "Δ". In actuality, each parameter is evaluated by using a numerical value. The evaluated results obtained as described above are assigned to the various forms of the antenna, and a look-up table is generated, so that it is possible to select an optimum form from the table in accordance with the conditions.

FIG. 31 is a flowchart showing the above-described procedure. First, in Step S1, the communication circuit starts the transmission of a predetermined signal. In Step S2, among a plurality of forms which can be taken by the antenna, a form selected as an initial form (N=1, i.e., the first form) is applied to the antenna. In Step S3, a reflected signal from the antenna having the form is detected. In Step S4, the directivity, the gain, and the impedance are measured. In Step S5, respective values of the directivity, the gain, and the impedance obtained by the measurement are stored in the memory as data of N=1.

Next, a form selected as the second form of N=2 is applied to the antenna, and then the operation of Steps S2 to S5 is repeated. The same operation is repeated a required number of times from the third form of N=3, so that measured results of the directivity, the gain, and the impedance can be obtained for all of or part of the forms which can be taken by the antenna.

These measured results are stored in the memory, so that a preferable form can be selected as needed in accordance with the conditions. If the contents of the memory are displayed on a display, a user can select the form of the antenna, based on the displayed contents. Alternatively, based on the contents of the memory, an antenna control apparatus may automatically determine the form of the antenna.

Next, a procedure for adjusting the form in the case where the antenna 50 is used as an antenna for reception will be described.

When a signal from external equipment is sent, the antenna 50 receives the signal, and the level of the received high frequency signal is detected by the level detector 71. As the external equipment, equipment which is especially designed for test can be used, but any other communication equipment can be used. When the apparatus of this embodiment is a device such as a portable information terminal, it is possible to optimize the antenna form by utilizing a signal which is publicly sent.

The directivity check section 72 determines whether the directivity in reception of the antenna 50 is in the allowable range, or not, based on the level of the received high frequency signal. Specifically, in the case where the level of a signal received by the antenna 50 varies depending on the direction of the antenna 50, if a difference in level of the received signals in respective directions is in a certain range, it is determined that the directivity is in the allowable range. Conversely, if the difference is not in the certain range, it is determined that the directivity is not in the allowable range. In this way, the directivity in reception of the antenna 50 is checked. Also in this case, there may be a case where it is desired that the directivity is as low as possible, and a case where it is desired that the directivity is as high as possible. Therefore, the range which is used for determining the directivity may be varied depending on the kinds and application of the equipment in which the antenna is used, and the purpose of reception or transmission.

In the case where the apparatus of this embodiment communicates with another communication equipment via an antenna, a preferred form of the antenna 50 may be varied depending on the position of the antenna of the other communication equipment. In such a case, a form which can receive a signal at high directivity from the antenna of the other communication equipment as destination can be selected.

The gain check section 73 checks the gain of the antenna 50, based on a condition whether an S/N ratio of the signal received by the antenna 50 is in the allowable range or not, and other conditions. In this case, it is desired that the S/N ratio be high. Therefore, if the ratio is a certain value or more, it is determined that the gain is good.

The impedance check section 74 checks the impedance matching property between the antenna 50 and the communication circuit 61 based on a condition where a ratio of the level of the signal received by the antenna 50 to the level of the signal reflected from the communication circuit 61 is in the allowable range, or not, and other conditions. Specifically, if a ratio in level of the received signal by the antenna 50 to the signal reflected from the communication circuit 61 is a certain value or more, it is determined that the impedance matching property is good.

Preferably, until it is determined that all of the directivity, the gain, and the impedance matching property are good, the designing of the form of the antenna is repeatedly performed, in the form designing section 53, and the driver 51 is adjusted again by the form design controller 54. When it is eventually determined that all of the directivity, the gain, and the input impedance matching property are good, information (data) relating to the form is stored in the memory 55.

The memory 55 stores an optimum form of the antenna 50 independently for the case where the antenna 50 is used for reception (stand-by condition) and for the case where the antenna 50 is used for transmission. Thus, in accordance with a switching signal for transmission/reception of the antenna 50, adjustment can be performed for changing the stored contents taken out of the memory 55 to the form designing section 53.

Alternatively, an antenna form in which the directivity is low in the stand-by condition is first adopted, and then in a stage where the reception of a radio wave signal starts, an antenna form suitable for receiving the radio wave signal is determined. In this way, optimization of the antenna form may be dynamically performed.

According to this embodiment, optimum forms of various types of antennas shown in the first to eighth embodiments can be dynamically determined and realized in accordance with the environments in which the antenna 50 is used and the kind of equipment in which the antenna is incorporated.

(Tenth Embodiment)

FIG. 32 is a block diagram showing another embodiment of the apparatus provided with the antenna of the present invention.

The apparatus of this embodiment includes, in addition to the configuration of the ninth embodiment, a plurality of probes for checking the directivity 75*a*, 75*b*, and 75*c* which are disposed in different positions. FIG. 32 shows an example in which the three probes 75*a* to 75*b* are disposed, but the number of probes may be four or more, or only two.

The operations or the functions of a form designing section 53, a form design controller 54, and a memory 55 in this embodiment are the same as the operations or the functions of the form designing section 53, the form design controller 54, and the memory 55 in the ninth embodiment.

Also in this embodiment, the gain and the impedance matching property are checked as described in the ninth embodiment. Hereinafter a method of checking the directivity which is characterized in this embodiment will be described.

First, a procedure for adjusting the form in the case where the antenna 50 is used as a transmitting antenna is described. In this embodiment, when a signal for transmission (generally, a signal standardized for test) is sent from the communication circuit 61 to the antenna 50, and the signal is transmitted from the antenna 50 to the external, signals with different intensities depending on the disposed positions are input into a level detector 71 by means of the respective probes 75*a* to 75*c*.

In the directivity check section 72, it is determined whether the directivity of the transmitting function of the antenna 50 is in the allowable range or not, based on the level of the high frequency signal. Specifically, in the case where the level of the received signal is varied depending on the respective probes 75*a* to 75*c*, if a difference in level of the received signals in the respective positions is in a certain range, it is determined that the directivity is in the allowable range. If the difference is not in the certain range, it is determined that the directivity is not in the allowable range. In this way, the directivity of the antenna 50 in transmission is checked. There may be a case where it is desired that the directivity be as low as possible, and a case where it is desired that the directivity be as high as possible. For this reason, the range used for checking the directivity can be varied depending on the type and application of the equipment in which the antenna is used, or the purpose of reception or transmission.

In the level detector 71, both of a level of the signal transmitted from the communication circuit 61 to the antenna 50 and a level of a signal received by the respective probes 75*a* to 75*c* are detected, so that the signal transmitted from the communication circuit to the antenna 50 and the reflected wave from the antenna can be additionally used for the check of the directivity.

Next, in the case where the antenna 50 is used as a receiving antenna, the probes 75*a* to 75*c* are not used. Similarly to the ninth embodiment, by using the level of a high frequency signal received by the antenna 50, the directivity in reception of the antenna 50 can be checked. It is understood that the signal received by the probes 75*a* to 75*c* can be used as reference.

In this embodiment, in addition to the effects in the ninth embodiment, the directivity of the antenna 50 in transmission can be checked based on the levels of the signal actually received by the probes 75*a* to 75*c*, so that it is possible to optimally adjust the directivity of the antenna 50 in transmission.

(Eleventh Embodiment)

FIG. 33 is a block diagram showing still another embodiment of the apparatus provided with the antenna of the present invention.

Also in this embodiment, the operations or the functions of a form designing section 53, a form design controller 54, and the memory 55 are the same as the operations or the functions of the form designing section 53, the form design controller 54, and the memory 55 in the ninth embodiment.

As shown in FIG. 33, the apparatus of this embodiment utilizes an external communication circuit 62. That is, a signal from the communication circuit 61 is transmitted through the antenna 50, and the transmitted signal is received by an antenna of external equipment. A signal transmitted from the external communication circuit 62 in response to the transmitted signal is received by the antenna 50, and utilized for the adjustment of the form of the antenna 50.

The communication circuit 62 of the external equipment is a circuit for transmitting information such as a time signal, or weather forecasting which is transmitted by making a call, for example. Depending on the application of the antenna 50, special external equipment for test having a communication circuit 62 can be prepared.

In this embodiment, the adjustment of the form of the antenna 50 can be simultaneously performed for both of the transmission and reception purposes. When the antenna 50 is used for transmission, the directivity, the gain, and the impedance matching property are checked by the procedure described in the ninth embodiment, that is, without using any external communication circuit. Only when the antenna 50 is used for reception, the external communication circuit 62 can be utilized. Also in this embodiment, similarly to the tenth embodiment, probes 75*a* to 75*c* can be disposed for checking the directivity.

A directivity check section 72 determines whether the directivity of the antenna 50 in transmission and in reception is in the allowable range or not, based on the level of the high frequency signal. Specifically, in the case where the level of the signal received by the antenna 50 is varied depending on the direction of the antenna 50, if a difference in level of the received signals in the respective directions is in a certain range, it is determined that the directivity in transmission and reception is in the allowable range. If the difference is not in the certain range, it is determined that the directivity is not in the allowable range. Accordingly, the directivity in transmission and reception of the antenna 50 can be checked. Also in this case, there may be a case where it is desired that the directivity be as low as possible, and a case where it is desired that the directivity be as high as possible. Therefore, the range for checking the directivity is varied depending on the type, the application, and the like of the equipment in which the antenna is used.

A gain check section 73 checks the gain of the antenna 50, based on the condition where the S/N ratio of the signal received by the antenna 50 is in the allowable range, or not, a ratio of the level of the signal transmitted from the communication circuit 61 to the level of the signal thereafter received by the antenna 50, or other conditions. In this case, it is desired that the S/N ratio and the ratio of the level of the received signal to the level of the transmitted signal be as high as possible. Thus, if the ratios are certain values or more, it is determined that the gain is good.

In addition, the impedance check section 74 checks the impedance matching property in transmission of the antenna 50, based on the level of the signal reflected from the antenna 50 in transmission. The impedance matching property between the antenna 50 and the communication circuit 61 is checked, based on the level of the signal reflected from the communication circuit 61 after being received by the antenna 50.

Preferably, until it is determined that all of the directivity, the gain, and the impedance matching property are good, the designing of the form of the antenna is repeatedly performed in the form designing section 53. By the form design controller 54 and the driver 51, the form of the antenna 51 is dynamically changed. It is eventually determined that all of the directivity, the gain, and the input impedance matching property of the antenna 50 are good, information (data) relating to the form is stored in the memory 55.

(Twelfth Embodiment)

FIG. 34 is a block diagram showing still another embodiment of the apparatus provided with the antenna of the present invention.

Also in this embodiment, the operations or the functions of a form designing section 53, a form design controller 54, and a memory 55 are the same as the operations or the functions of the form design controller 54 and the memory 55 in the ninth embodiment.

As shown in FIG. 34, the apparatus of this embodiment includes, instead of the level detector 71 in the eleventh embodiment, a data analyzer 76. In this embodiment, it is assumed that an external communication circuit 62 is utilized. After a signal from a communication circuit 61 is transmitted through an antenna 50, the signal is received by an antenna of external equipment. A signal transmitted from the external communication circuit 62 in response to the signal transmitted from the antenna 50 is received by the antenna 50, and the received signal is utilized for adjusting the form of the antenna 50.

The communication circuit 62 of the external equipment in this embodiment is a circuit for, when a certain test signal is received, outputting a digital signal in response to the test signal. As the communication circuit 62 of the external equipment, for example, a circuit for transmitting information such as a time signal, or weather forecasting transmitted by making a call can be utilized.

In the eleventh embodiment, the form of the antenna 50 is adjusted in accordance with the levels of the transmitted and received signals. In this embodiment, by comparing the data contents of the transmitted and received signals, it is determined whether the directivity, the gain, and the impedance matching property are in optimum ranges, or not. Other functions are the same as those in the eleventh embodiment.

Also in this embodiment, similarly to the tenth embodiment, probes 75*a* to 75*c* can be disposed for checking the directivity.

(Thirteenth Embodiment)

FIG. 35 is a block diagram showing still another embodiment of the apparatus provided with the antenna of the present invention.

The apparatus of this embodiment includes a form mechanism producing section 56, instead of the driver 51 in the ninth embodiment. Also in this case, the operations or the functions of a form designing section 53, a form design controller 54, and a memory 55 are the same as the operations or the functions of the form designing section 53, the form design controller 54, and the memory 55 in the ninth embodiment.

In this embodiment, by way of the same procedure as that in the eleventh embodiment, the form of an antenna 50 is judged, based on the directivity, the gain, the impedance matching property, and the like in respective cases where the antenna 50 functions as an antenna for transmission/reception, and an appropriate antenna form can be determined. In this embodiment, the form of the antenna cannot be dynamically changed during the use of the antenna. The form of the antenna is determined in a process step for producing an apparatus in which the antenna is incorporated.

Also in this case, similarly to the tenth embodiment, probes 75*a* to 75*c* can be disposed for checking the directivity.

[Antenna Module]

In the above-described respective embodiments of the apparatus provided with the antenna, the driver 51, the form design controller 54, and the like as shown in FIG. 29 are disposed in various apparatuses such as terminal devices. A component in which a circuit for determining an antenna form (a control circuit for an antenna) is integrated with an antenna can be produced as an antenna module, and marketed.

FIG. 36 shows an antenna module in which the antenna of the present invention is integrated with a circuit for controlling the form of the antenna. In the antenna module, the antenna 50 of the present invention is fixed on a package 80 of an integrated circuit chip. A circuit system formed in the integrated circuit chip includes antenna control circuits such as the driver 51, the form designing section 53, the form design controller 54, the memory 55, the level detector 71, the directivity check section 72, the gain check section 73, the impedance check section shown in FIG. 29, and preferably includes the communication circuit 61.

Such an antenna module is used by being incorporated in an apparatus 90 such as a portable terminal (including a cellar phone) shown in FIG. 36. An appropriate form of the antenna is varied depending on the apparatus 90 on which the antenna module is mounted, and the use environments of the apparatus 90. According to the antenna module of the present invention, the form of the antenna is automatically changed to be an optimum form depending on the use conditions of the portable terminal.

FIG. 37(*a*) schematically shows the directivity of the antenna 50 in a stand-by mode of the portable terminal in FIG. 36. In the stand-by mode, the form of the antenna 50 is set so as to exhibit a wide directivity. In a mode for searching a destination for communication, a form with a strong directivity is given to the antenna 50, and the form is sequentially changed. Thus, as shown in FIG. 37(*b*), the direction in which the antenna 50 has the strong directivity is changed. In the above-described search mode, when the direction of the source of the ratio waves generated from the other terminal is found, as shown in FIG. 37(*c*), the form in which the directivity is the strongest in the direction of the source is given to the antenna 50, and the transmission/reception of the radio waves is efficiently performed.

(Fourteenth Embodiment)

Figure 38:
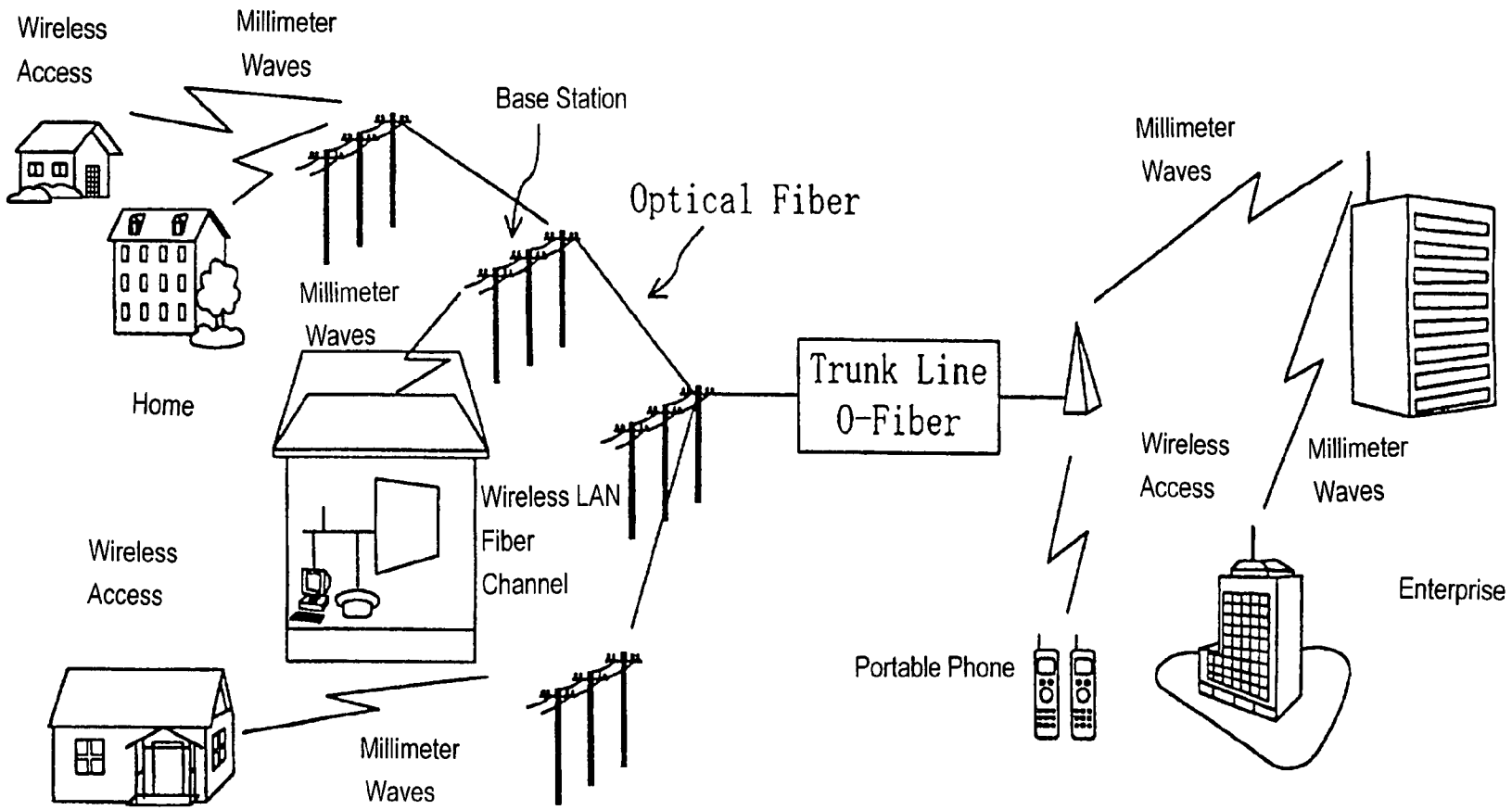
FIG. 38 is a block diagram showing an example of a communication system in which the antenna of the present invention is employed.

FIG. 38 is a perspective view showing an example of a communication system in which the antenna of the present invention is used. FIG. 38 exemplarily shows a communication system utilizing millimeter waves. As shown in the figure, base stations are disposed on tips of a large number of line optical fibers branched from a trunk line optical fiber (Trunk Line O-Fiber). In addition, wireless communication net is formed from the respective base stations to the respective homes (or offices) for performing the communication by using millimeter waves. In wireless terminals (or mobile stations) in respective homes or offices, the supply of various media from the base station to the devices in the respective homes or offices, the internet communication, the communication between mobile stations, and the like can be performed. That is, the millimeter waves are easily subjected to electronic jamming by a material body, because the millimeter waves have a wavelength which is closer to that of light. Therefore, transmission and reception of data by way of optical communication via optical fiber net to the base station, and conversion is performed between an optical signal and an electric signal in the base station. Between the home or office and the base station, wireless access can be performed by utilizing millimeter waves.

The antenna of the present invention is suitably used for transmission and reception when the above-described wireless access is performed. In part of the system, between a base station directly connected to a trunk line optical fiber and a portable information terminal or a terminal in an office, wireless access can be performed via the antenna of the present invention.

Figure 39:
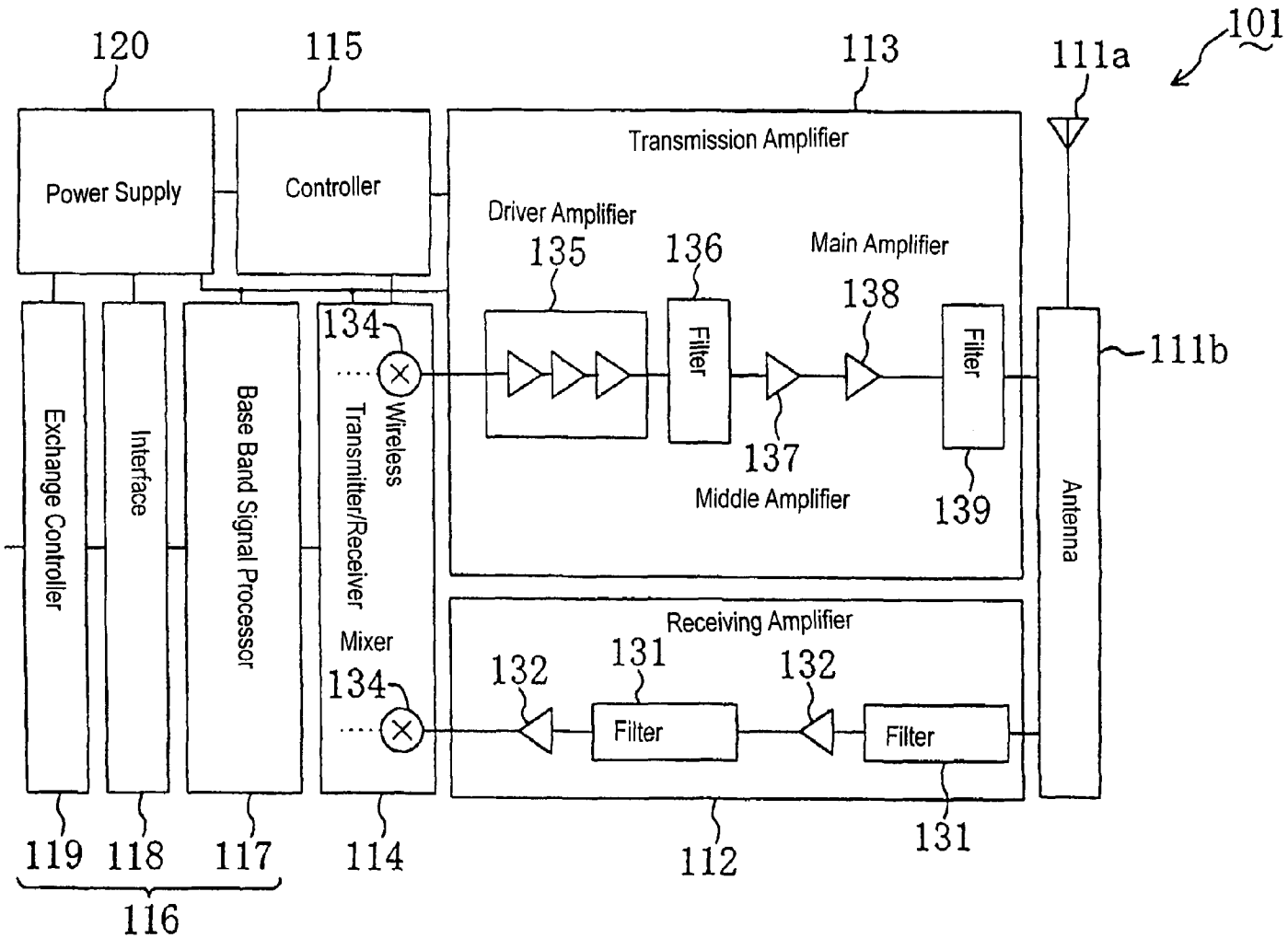
FIG. 39 is a block diagram schematically showing a configuration of communication system between the base station and wireless terminals in respective homes and offices shown in FIG. 38.
Figure 4:
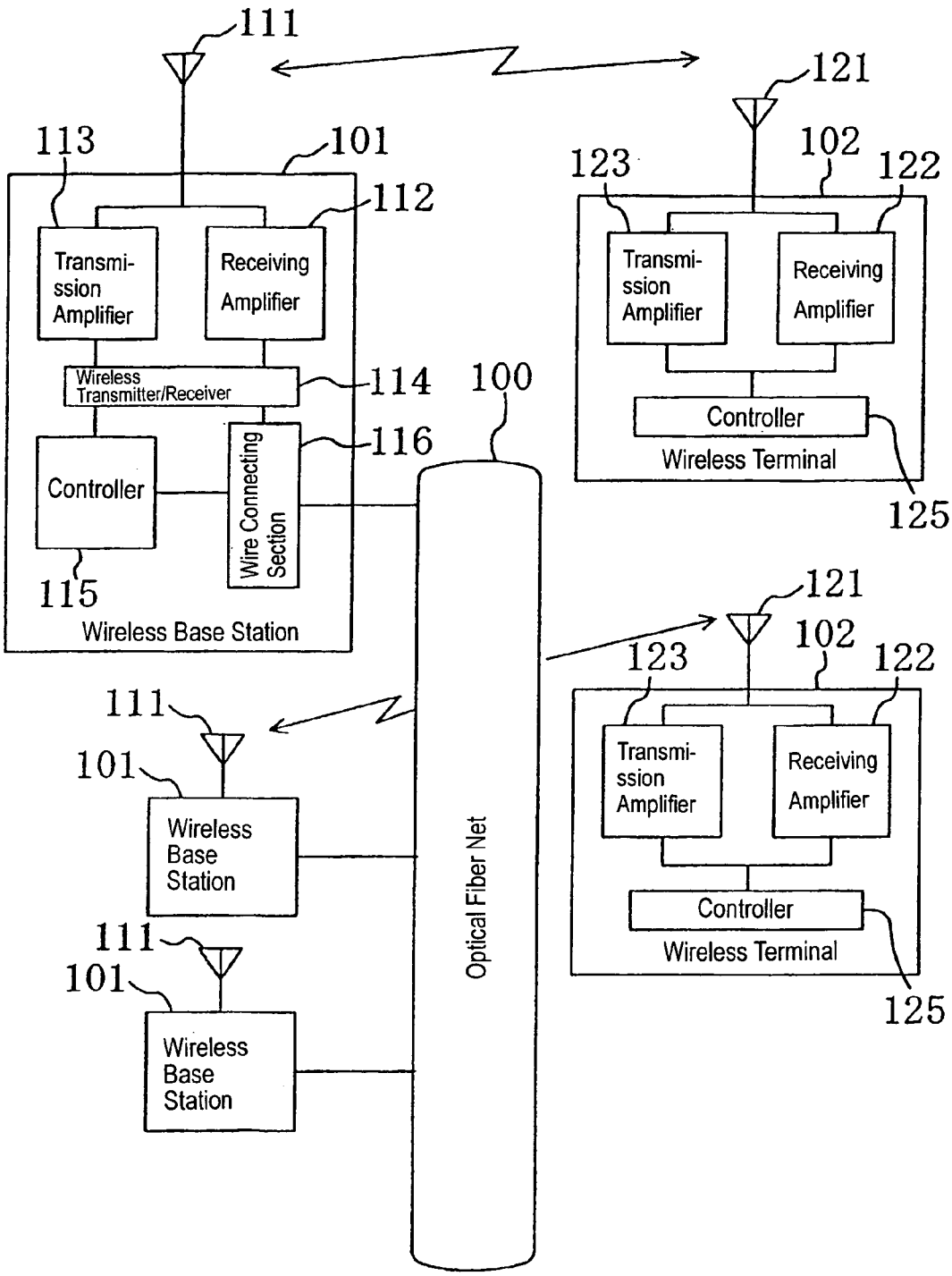

FIG. 39 is a block diagram schematically showing a configuration of a communication system between the base station shown in FIG. 38 and a wireless terminal in each home or office. The communication system shown in the figure includes a number of base stations 101 mutually connected by an optical fiber net (network) 100, and wireless terminals 102 for mutually performing communication via the respective base stations 101. Each of the base stations 101 includes an antenna device 111 for receiving and transmitting radio waves, a receiving amplifier 112 having functions such as a function of amplifying a radio wave signal received by the antenna device 111, a transmission amplifier 113 for transmitting an amplified high frequency signal to the antenna device 111, a wireless transmitter/receiver 114 connected to the receiving amplifier 112 and the transmission amplifier 113, a controller 115 for controlling the operations of the respective devices, and a wire connecting section 116 for connecting a signal between the base station 101 and the optical fiber net 100. The wireless terminal 102 includes an antenna device 121 for performing the reception and transmission of radio waves, a receiving amplifier 122 having functions such as a function of amplifying a radio wave signal received by the antenna device 121, a transmission amplifier 123 for transmitting an amplified high frequency signal to the antenna device 121, and a controller 125 for controlling the operations of the respective devices.

FIG. 40 is a block circuit diagram showing an inner configuration of the base station 101 in more detail. As shown in the figure, the antenna device 111 is constituted by an antenna 11*a*, and an antenna switch 111*b* for performing the switching between the transmission and the reception of the antenna 111*a*. The receiving amplifier 112 is constituted by two sets of a filter 131 and a low noise amplifier (LNA) 132 which are disposed in series. In the wireless transmitter/receiver 114, a mixer 134 for generating a high frequency signal by mixing outputs of a local amplifier and a high frequency oscillator is disposed. In the transmission amplifier 113, a driver amplifier 135, a filter 136, a middle amplifier 137, and a main amplifier 138 are disposed. The wire connecting section 116 is constituted by a base band signal processor 117 for processing a sound signal, an interface 118, and an exchange controller 119 connected to the optical fiber net (network) 100. Although not shown in the figure, a signal converter for performing conversion between an optical signal to an electric signal is disposed in the interface 118.

The antenna of the present invention is used as the antenna 111*a*, and functions as one slot in a slot antenna, for example.

INDUSTRIAL APPLICABILITY

According to the present invention, an array of small conductor elements each of which cannot independently function as an antenna is utilized, so as to provide an antenna in which a current pattern or a magnetic current pattern can be changed in a wide variety of ways.

The invention claimed is:

1. Antenna comprising:

an array of a plurality of conductor elements which are mutually separated, and each of which does not independently function as an antenna;

coupling means for electro-magnetically coupling at least two conductor elements selected from the plurality of conductor elements, thereby causing the plurality of coupled conductor elements to function as one antenna element; and a dielectric layer for supporting the plurality of conductor elements, wherein the coupling means includes conducting means for electrically connecting the plurality of selected conductor elements, the conducting means includes a group of conductor pieces overlapping at least two adjacent conductor elements, the conductor piece is disposed so as to electrically connect the selected conductor elements, and the antenna further comprises a dielectric film interposed between the respective conductor elements and the respective conductor pieces.

2. The antenna of claim 1, wherein the array of the conductor elements includes a matrix portion in which the plurality of conductor elements are arranged in a matrix of rows and columns.

3. The antenna of claim 2, wherein the matrix portion of the array is constituted by conductor elements having substantially the same shape.

4. The antenna of claim 2, wherein the matrix portion of the array is constituted by conductor elements having substantially the same size.

5. The antenna of claim 2, wherein each of the plurality of conductor elements has a size smaller than a wavelength of radio wave to be transmitted and/or received.

6. The antenna of claim 1, wherein the conducting means includes a plurality of switching elements for switching electrically conducting/non-conducting conditions between two conductor elements.

7. The antenna of claim 6, wherein the plurality of switching elements are arranged in a matrix of rows and columns.

8. The antenna of claim 7, further comprising a wiring layer for connecting a circuit for driving the plurality of switching elements to the plurality of switching elements.

9. The antenna of claim 6, wherein the switching elements are transistors.

10. The antenna of claim 6, wherein the switching element includes a conductor piece which is movably supported, and an actuator for moving the conductor element, and the actuator can reciprocate the conductor piece between a first position in which a plurality of adjacent conductor elements are electrically connected by the conductor piece and a second position in which a plurality of adjacent conductor elements are not electrically connected.

11. An antenna module comprising:

the antenna of claim 6; and a driving circuit for generating a signal for driving the plurality of switching elements.

12. An apparatus comprising:

the antenna of claim 6;

a driving circuit for generating a signal for driving the plurality of switching elements; and control means for controlling the operation of the driving circuit, based on a signal received and/or transmitted by the antenna.

13. The antenna of claim 1, wherein the dielectric layer has a first main face on which the array of conductor elements is disposed, and a second main face opposite to the first main face, and a grounding conductor is formed on the side of the second main face.

14. The antenna of claim 1, wherein the dielectric layer, the conductor elements, and the conducting means are laminated.

15. The antenna of claim 14, wherein the conducting means is provided in a movable manner, and the antenna further comprises a moving mechanism for moving the conducting means between a conducting position in which the at least two conductor elements are made to mutually and effectively conduct, and a non-conducting position other than the conducting position.

16. Antenna comprising:

an array of a plurality of conductor elements which are mutually separated, and each of which does not independently function as an antenna;

coupling means for electro-magnetically coupling at least two conductor elements selected from the plurality of conductor elements, thereby causing the plurality of coupled conductor elements to function as one antenna element; and a dielectric layer for supporting the plurality of conductor elements, wherein the coupling means includes conducting means for electrically connecting the plurality of selected conductor elements, wherein part of a plurality of conductor elements selected from the plurality of conductor elements function as a grounding conductor.

17. Antenna comprising:

an array of a plurality of conductor elements which are mutually separated, and each of which does not independently function as an antenna; and coupling means for electro-magnetically coupling at least two conductor elements selected from the plurality of conductor elements, thereby causing the plurality of coupled conductor elements to function as one antenna element, wherein the coupling means includes a conductor layer, and a plurality of dielectric elements disposed between the conductor layer and each of the conductor elements, and the selected conductor elements are more strongly capacitive-coupled to the conductor layer than the conductor elements which are not selected.

18. The antenna of claim 17, wherein the array of the conductor elements includes a matrix portion in which the plurality of conductor elements are arranged in a matrix of rows and columns.

19. The antenna of claim 18, wherein the matrix portion of the array is constituted by conductor elements having substantially the same shape.

20. The antenna of claim 18, wherein the matrix portion of the array is constituted by conductor elements having substantially the same size.

21. The antenna of claim 18, wherein each of the plurality of conductor elements has a size smaller than a wavelength of radio wave to be transmitted and/or received.

22. The antenna of claim 17, wherein the dielectric elements positioned between the selected conductor elements and the conductor layer are thinner than the dielectric elements positioned between the conductor elements which are not selected and the conductor layer.

23. The antenna of claim 17, wherein a specific inductive capacity of the dielectric elements positioned between the selected conductor elements and the conductor layer is larger than a specific inductive capacity of the dielectric elements positioned between the conductor elements which are not selected and the conductor layer.

24. The antenna of claim 17, further comprising an actuator for moving the conductor elements so as to change a distance between each of the conductor elements and corresponding ones of the dielectric elements.

25. The antenna of claim 17, wherein the dielectric elements and the conductor elements are layered a plurality of times.

26. An apparatus comprising:

an antenna including:

an array of a plurality of conductor elements which are mutually separated, and each of which does not independently function as an antenna; coupling means for electro-magnetically coupling at least two conductor elements selected from the plurality of conductor elements, thereby causing the plurality of coupled conductor elements to function as one antenna element; and a dielectric layer for supporting the plurality of conductor elements, the coupling means including conducting means for electrically connecting the plurality of selected conductor elements, the conducting means including a plurality of switching elements for switching electrically conducting/non-conducting conditions between two conductor elements;

a driving circuit for generating a signal for driving the plurality of switching elements;

control means for controlling the operation of the driving circuit, based on a signal received and/or transmitted by the antenna; and evaluating means for evaluating directivity, gain, and/or impedance of the antenna, based on the signal, wherein conductor elements to be electrically connected are dynamically selected from the plurality of conductor elements, based on the evaluated result.

27. The apparatus of claim 26, wherein the evaluating means evaluates the directivity, gain, and/or impedance of the antenna for each of a plurality of combinations of conductor elements which are electrically and mutually connected by the switching elements.

28. The apparatus of claim 27, further comprising:

a memory for storing the evaluated results for the plurality of combinations of the conductor elements; and a form designing section for selecting conductor elements to be electrically and mutually connected by the switching elements and for controlling the operation of the driving circuit, based on the evaluated results stored in the memory.

29. A system comprising a plurality of apparatuses of claim 28, wherein communications are performed between the plurality of apparatuses by radio waves via antennas of the respective apparatuses, and connection patterns of the plurality of conductor elements are dynamically changed for defining forms of the antennas of the respective apparatuses.

* * * * *